US012082694B2

(12) United States Patent
Höglund

(10) Patent No.: US 12,082,694 B2
(45) Date of Patent: Sep. 10, 2024

(54) TELESCOPIC LEG FOR FURNITURE

(71) Applicant: Per Höglunds Innovation AB, Jönköping (SE)

(72) Inventor: Per Höglund, Jönköping (SE)

(73) Assignee: Per Höglunds Innovation AB, Jönköping (SE)

( * ) Notice: Subject to any disclaimer, the term of this patent is extended or adjusted under 35 U.S.C. 154(b) by 73 days.

(21) Appl. No.: 17/764,025

(22) PCT Filed: Nov. 5, 2020

(86) PCT No.: PCT/EP2020/081102
§ 371 (c)(1),
(2) Date: Mar. 25, 2022

(87) PCT Pub. No.: WO2021/089685
PCT Pub. Date: May 14, 2021

(65) Prior Publication Data

US 2022/0338617 A1 Oct. 27, 2022

(30) Foreign Application Priority Data

Nov. 8, 2019 (SE) ..... 1951289-6

(51) Int. Cl.
*A47B 9/04* (2006.01)
*A47B 9/20* (2006.01)

(52) U.S. Cl.
CPC ..... *A47B 9/04* (2013.01); *A47B 9/20* (2013.01); *A47B 2009/046* (2013.01); *A47B 2200/0052* (2013.01); *A47B 2200/0059* (2013.01)

(58) Field of Classification Search
CPC ..... A47B 9/04; A47B 9/20; A47B 2009/046; A47B 2200/0052; A47B 2200/0059
(Continued)

(56) References Cited

U.S. PATENT DOCUMENTS 3,908,565 A * 9/1975 Burnett ..... A47B 23/046 108/150
6,070,840 A * 6/2000 Kelley ..... A47B 9/04 248/188.4

(Continued)

FOREIGN PATENT DOCUMENTS

DE 19920935 A1 11/2000
DE 202008013317 U1 12/2008

(Continued)

OTHER PUBLICATIONS

International Search Report and Written Opinion for International Application No. PCT/EP2020/081102, mailed Feb. 2, 2021, (11 pages).

(Continued)

*Primary Examiner* — Jose V Chen
(74) *Attorney, Agent, or Firm* — Kagan Binder, PLLC

(57) ABSTRACT

A telescopic column (100) for height-adjustable table (120), said telescopic column extending along a longitudinal axis from a first end (102) to a second end (103) of said telescopic column (100), comprising: an outer elongated tube (10) fixedly arranged at said second end (103) of said telescopic column (100), an inner elongated tube (20) having a top end (22) and bottom end (23), wherein said top end (22) defines said first end (102) of the telescopic column (100), and wherein the inner elongated tube (20) is sized and adapted to move into and out of said outer tube (10), drivable by a driving unit (150) along said longitudinal axis between a maximum height (112) and a minimum height (111), and an intermediate element (30) having a lower portion (31) being sized and adapted to engage the outer tube (10) from the inside thereof, a middle portion (32) being sized and adapted to be fitted into the inner tube (20) and engage the inner tube (20) from the inside FIG. 1*a* thereof, and an upper portion (33) being sized and adapted to be remain within the inner (Continued)

tube (20), so as to provide for stability, wherein said intermediate element (30) is passively moved by means of the inner tube (20) when said telescopic column (100) is moved between said maximum height (112) and said minimum height (111), a motor (150), substantially arranged external to the telescopic column (100), for providing rotary motion to a worm screw (156) extending into the telescopic column (100), and driving a worm wheel (66), a hollow bearing sleeve (60) drivably arranged to the worm wheel (66) from the inside thereof, and coupled to a leadscrew (50) so that the leadscrew (50) rotates about the longitudinal axis with the bearing sleeve (60) driven by the motor (150).

20 Claims, 23 Drawing Sheets

(58) Field of Classification Search
USPC ..... 108/147, 147.19
See application file for complete search history.

(56) References Cited

U.S. PATENT DOCUMENTS

| | | | | |
|---|---|---|---|---|
| 6,484,648 | B1 * | 11/2002 | Long | A47B 9/04 108/147 |
| 7,559,516 | B2 * | 7/2009 | Koder | A47B 9/04 248/161 |
| 9,629,452 | B1 * | 4/2017 | Chen | A47B 9/20 |
| 9,723,920 | B1 | 8/2017 | Wu | |
| 10,531,732 | B1 * | 1/2020 | Huang | F16B 7/14 |
| 10,555,602 | B1 * | 2/2020 | Lu | A47B 9/04 |
| 2002/0050112 | A1 * | 5/2002 | Koch | F16C 33/3856 52/651.07 |
| 2003/0183027 | A1 * | 10/2003 | Koch | F16H 25/20 74/89.35 |
| 2008/0178779 | A1 * | 7/2008 | Agee | A47B 9/04 108/147 |
| 2011/0023758 | A1 * | 2/2011 | Overgaard | A47B 9/06 108/147 |
| 2011/0120243 | A1 * | 5/2011 | Pettersson | F16M 11/04 74/89.28 |
| 2016/0281912 | A1 * | 9/2016 | Christen | F16B 7/10 |
| 2017/0135466 | A1 * | 5/2017 | Randløv | A47B 9/04 |
| 2018/0140087 | A1 * | 5/2018 | Wu | F16H 25/2056 |
| 2019/0261778 | A1 * | 8/2019 | Lukas | G01S 7/497 |
| 2019/0284031 | A1 * | 9/2019 | Huang | A47B 9/10 |
| 2019/0357668 | A1 * | 11/2019 | Knudtson | A47B 9/04 |
| 2020/0214439 | A1 * | 7/2020 | Bennett | A47B 9/20 |
| 2021/0215236 | A1 * | 7/2021 | Lukas | A47C 20/041 |
| 2022/0243793 | A1 * | 8/2022 | Hu | F16H 25/2454 |

FOREIGN PATENT DOCUMENTS

| | | | |
|---|---|---|---|
| EP | 3378350 | A1 | 9/2018 |
| WO | 2009126036 | A1 | 10/2009 |
| WO | 2018192358 | A1 | 10/2015 |
| WO | 2018054433 | A1 | 3/2018 |

OTHER PUBLICATIONS

Swedish Office Action for Swedish Application No. 1951289-6, mailed on May 14, 2020, (12 pages).
Swedish Office Action for Swedish Application No. 1951289-6, mailed on Jul. 7, 2021, (6 pages).
E-Spacenet English Abstract and Machine Translation for DE 19920935 A1.
E-Spacenet English Machine Translation for DE 202008013317 U1.
E-Spacenet English Abstract for WO 2018192358 A1.
Communication Pursuant to Article 94(3) for European Application No. 20804186.3, mailed Apr. 19, 2014, (6 pages).

* cited by examiner

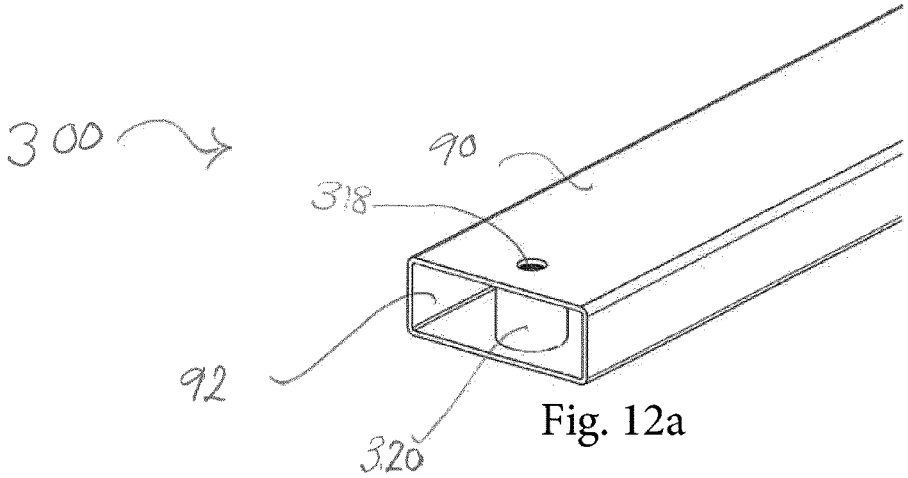
Fig. 12a
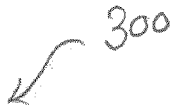
Fig. 12b
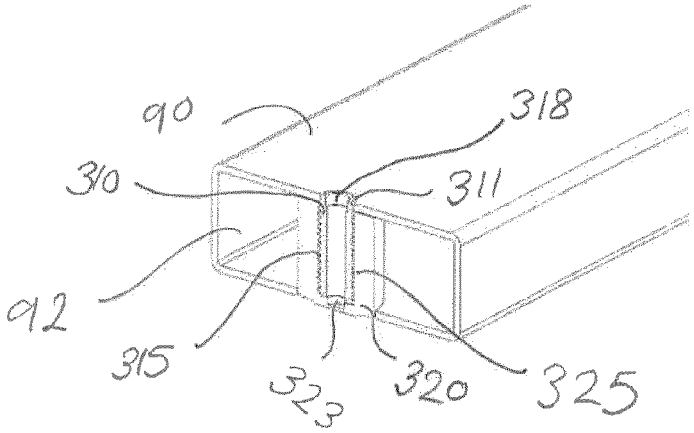

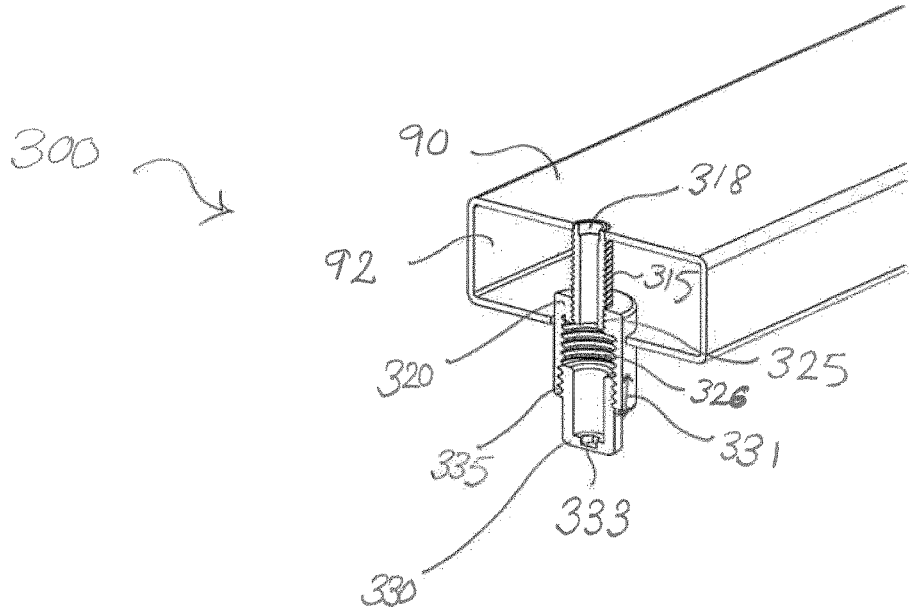
Fig. 15a
Fig. 15b
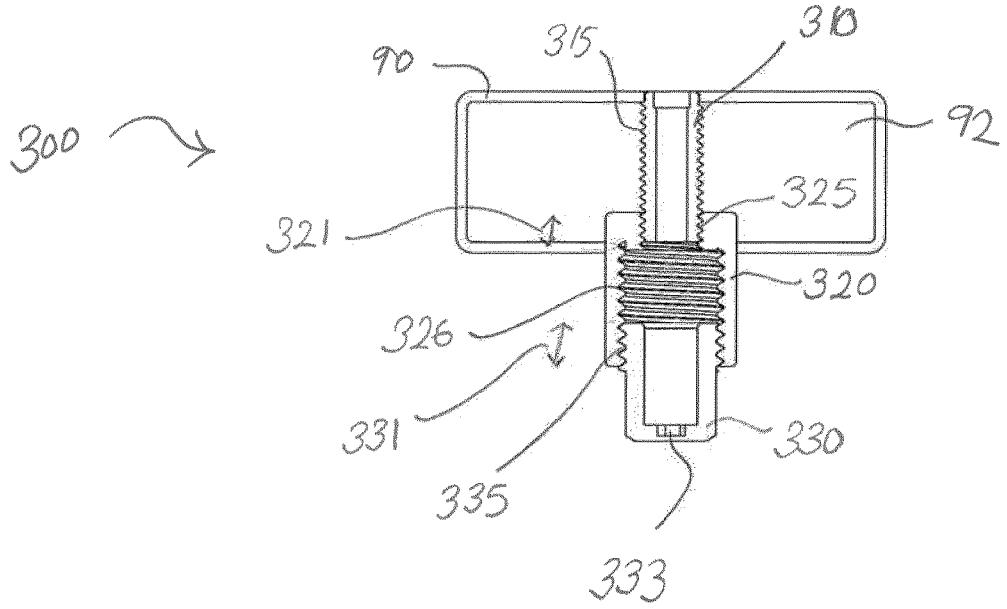

TELESCOPIC LEG FOR FURNITURE

CROSS-REFERENCE TO RELATED APPLICATIONS

This application claims priority to International Application No. PCT/EP2020/081102, filed Nov. 5, 2020 and titled "TELESCOPIC LEG FOR FURNITURE," which in turn claims priority from a Swedish Patent Application having serial number 1951289-6, filed Nov. 8, 2019, both of which are incorporated herein by reference in their entireties.

TECHNICAL FIELD

The present disclosure generally relates to a telescopic column for height adjustable furniture.

BACKGROUND

In height-adjustable furniture, for example height adjustable tables, the height of the table top can be raised or lowered. These tables have legs in the shape of telescopic columns, each leg having two or more elongated tubes that are arranged in a concentric manner in relation to one another. The table top is arranged on one end of these legs. In connection with the legs, an arrangement for changing the height of the table top is devised, which drives the concentric elongated tubes in the longitudinal direction, out of, or into each other. This arrangement may be a linear actuator positioned inside, and connected to the tubes, while being driven by an electric motor. The concentric elongated tubes can thus be driven in a first direction out of each other, to lengthen the legs, thereby increasing the height of the table, or in an opposite direction so that they are driven into one another, causing the legs to shorten, thereby decreasing the height of the table.

These telescopic columns are usually columns comprising two, three or more tube-shaped telescopic parts. In these designs, in order to lengthen the legs in a stable manner, it becomes necessary that the adjacent tubes of the columns have an overlapping portion when the leg is at its maximum extension.

The two-tube telescopic columns usually have the advantage of a simpler linear actuator, that drives the raising/lowering of the leg. An example of these two-tube column legs is disclosed in WO18056886A1.

However, such two-tube designs have a shorter extension height coverage, typically ranging between 650 mm at the most compact position of the leg, and 1150 mm at maximum extension. The limited height range is mainly due to stability reasons rooted in an optimal aspect ratio of the telescopic leg at its maximum extension.

In order to increase the extension length of the telescopic leg further, telescopic columns comprising three tubes are utilized. In addition to the inner, and the outer telescopic parts of the two-tube columns, these columns comprise a center telescopic segment. An example of such a three-tube telescopic leg is given in WO2018199827. This document discloses a telescopic column for height-adjustable furniture, comprising a linear actuator comprising a first spindle secured to a first end of the column, a tube at least partly enclosing the first spindle and a second spindle at least partly arranged inside the tube and secured to a second end of the column. The telescopic column further comprises an inner telescope part fixedly arranged to a second end of the column, a center telescope part connected to the tube, and an outer telescope part fixedly arranged to the first end of the column. The telescopic column further comprises a device that connects the center telescope part to the tube, the device being arranged to the tube and to the center telescope part in such a way that the center telescope part is movable along the longitudinal axis in relation to the tube. Three-tube columns can cover a wider range of heights, however the actuator design and operation become much more complex and costly, as a result of the actuator being required to drive the center telescopic segment of the column as well. Therefore, there is a need for a height-adjustable table that has a large adjusting range, but a lower cost compared to state of the art.

SUMMARY

The two-tube columns are substantially cheaper as driving them requires less complex, hence more cost efficient means. The inventor has realized that when using only two tube solutions a significant length of the tubes is not participated in accessing the desired maximum height, as this guarantees stability of the table legs. Therefore, in order to reach a larger range of accessible heights with two-tube columns, there is a need to eliminate overlapping of the tubes while simultaneously maintaining stability.

According to a first aspect of the invention, this and other objects are achieved by a telescopic column for height-adjustable furniture, the telescopic column extending along a longitudinal axis from a first end to a second end of the telescopic column, comprising: an outer elongated tube fixedly arranged at the second end of the telescopic column, an inner elongated tube having a top end and bottom end, wherein the top end defines the first end of the telescopic column, and wherein the inner elongated tube is sized and adapted to move into and out of said outer tube, drivable by a driving unit along the longitudinal axis between a maximum height and a minimum height, and an intermediate element having a lower portion being sized and adapted to engage the outer tube from the inside thereof, a middle portion being sized and adapted to be fitted into the inner tube and engage the inner tube from the inside thereof, and an upper portion being sized and adapted to be remain within the inner tube, so as to provide for stability, wherein the intermediate element is passively moved by means of the inner tube when said telescopic column is moved between the maximum height and the minimum height.

It is noted that the term "furniture" should be widely interpreted in the context of this invention, so as to cover any appliance or equipment into which the telescopic column according to this invention may be integrated, such as, but not limited to adjustable workplaces.

In one embodiment, the inner and outer tubes may be concentric.

By passive movement of the intermediate element it is meant that the movement of the intermediate element is not actively controlled by the driving unit. Therefore, unlike the three-tube column solutions wherein movement of at least two members need to be actively controlled separately, and in relation to each other, giving rise to the complexity of these systems, in the solution provided by this invention a simple driving unit may be provided that solely controls one moving member. According to this invention, this member would be the inner tube. This simplifies driving the column within a larger range of heights than previously reachable by two-tube columns, hence substantially reducing the cost, while still allowing for stability.

In one embodiment, the inner tube further comprises an engaging portion, and the intermediate element further comprising a corresponding engaging element adapted to interact with the engaging portion of the inner tube, so as to move the intermediate element during an expansion stroke.

By an expansion stroke it is meant that the telescopic column is being expanded, so to increase its length. The maximum height of the telescopic column will then mark the upper limit of this stroke.

According to this invention, the full expansion stroke is carried out as follows: From the minimum height of the column, the inner tube is driven outwards from the outer tube, when the engaging portion of the inner tube meets the corresponding engaging element on the intermediate element, it will pull the intermediate element with it in the outward direction, only to be stopped when reaching the maximum height.

In one embodiment, the engaging element of the intermediate element defines the onset of the upper portion of the intermediate element.

The engaging element may be arranged in a central portion of the intermediate element, so to provide for stability by confining a substantial portion of the intermediate element, that being the upper portion, within the inner tube, and additionally, allowing the intermediate portion to extend into both the inner and outer tube. By arranging the engaging element in a central portion, the portion above the central portion will be placed inside then inner tube and the portion below the central portion will be placed inside the outer tube and thereby maximizing the stability provided by the intermediate element in full extension.

In one embodiment, the bottom end of the inner tube is adapted to interact with the lower portion of the intermediate element so as to move the intermediate element during a contraction stroke.

The upper, middle, and lower portions of the intermediate element may be continuous portions, only differentiated by their functionality and their positioning. The lower portion may be slightly protruding the periphery of the inner tube (explained more in detail below), while the middle and upper portions have substantially the same shape and dimensions, so as to fit inside the inner tube. The upper portion is confined within the inner tube only by means of interaction of the engagement element with the engaging portion of the inner tube when the column is being expanded.

By a contraction stroke it is meant that the telescopic column is being retracted, so to decrease its length. The minimum height of the telescopic column will therefore mark the lower limit of this stroke.

According to this invention, the full contraction stroke is carried out as follows: From the maximum height of the column, the inner tube is driven inwards to the outer tube, when the bottom end of the inner tube meets the lower portion of the intermediate element, it will push the intermediate element with it as it continues its movement within the outer tube, only to be stopped when the minimum height is reached. As explained in later in the text, in tables comprising this telescopic column within their legs, the minimum height may be reached within the bottom of a cavity within the table foot. The cavity bottom will provide a physical barrier to prevent the column being pushed even further (specifically in case the driving unit is malfunctioning).

In one embodiment, the entirety of the middle portion of the intermediate element is arranged inside the inner tube when the telescopic column is in the minimum height.

This is beneficial for achieving a lower minimum height, as the entire length of the intermediate element except the lower portion will be accommodated within the inner tube, therefore not contributing to the total height of the telescopic column. The lower portion may be a significantly small portion such as 10%, 5%, 1%, or only 0.2% of the entire length of the intermediate element.

In one embodiment, when extended to the maximum height, the inner tube is substantially moved out of said outer tube.

The inner tube may have less than 30% overlap, 20% overlap, 10% overlap, 5% overlap, 1% overlap, or no overlap at all with the outer tube when at maximum height of the column. It is however notable that, in order to have stability, it would be beneficial to have some overlap between the inner and outer tube. Otherwise it could be that depending on the relative thickness of the outer tube and the intermediate element, the column will wobble as a result of the inevitable gap between the latter mentioned members.

In one embodiment, the lower portion of the intermediate element comprises at least one protrusion arranged to protrude from the periphery of the inner tube when the middle portion of the intermediate element is within said inner tube.

This may prevent the intermediate element from going entirely into the inner tube, in the mean while allowing the inner tube to push the intermediate element downwards during the contraction stroke.

In one embodiment, the intermediate element comprises at least one groove on a portion of an outer surface of the middle portion of the intermediate element, the groove positioned between the engaging element and the lower portion, and arranged to accommodate said engaging portion of the inner tube.

This may allow for smooth movement of the engaging portion of the inner tube along said longitudinal direction.

According to another aspect of the present invention, a table is provided comprising at least one leg, each leg comprising a telescopic column according to the first aspect of the invention, wherein the telescopic column is fixedly attached to the table from the top end of the inner tube, and fixedly attached to a foot element at a bottom end of the outer tube.

It may be that only one leg comprises the telescopic column defined by the first aspect that is actively driven by the driving unit, while the other leg(s) are passive legs.

The top end of the inner tube may be attached to the bottom side of the table top.

The bottom end of the outer tube may be fixed onto or within the foot element.

In one embodiment, the bottom end of said outer tube is arranged into a cavity of the foot element, so as to allow the inner tube to enter the foot element when the table is in the minimum height position.

The table foot may be a hollow component, comprising an outer, shape defining body with a certain thickness. In this case the bottom end of the outer tube of the telescopic column will be adjusted within the hollow body of the foot, and attached to an inner side of the outer body. Alternatively, it could be that the foot is not hollow, but comprises a cavity devised to harbor the bottom end of the outer tube. In either case, accommodating the bottom end of the outer tube within the foot element, will increase the accessible height range through further lowering the minimum height by the height of the table foot.

In another aspect of the present invention, a table is provided. The table may comprise a telescopic column according to any of the above-mentioned embodiments of the invention. However, the table does not have to have a telescopic column with the above mentioned features, but may be a standalone table. However, if the table does comprise the telescopic column above, the synergetic effect is that the minimum height of the table is further decreased, as well as that the driving is enabled in a simple and inexpensive manner. The table may comprise: a motor, substantially arranged external to the telescopic column, for providing rotary motion to a worm screw extending into the telescopic column, and driving a worm wheel, a hollow bearing sleeve drivably arranged to the worm wheel from the inside thereof, and coupled to a leadscrew so that the leadscrew rotates about the longitudinal axis with the bearing sleeve driven by the motor, a receiving nut with threads for engaging the leadscrew, the receiving nut being coupled to an output shaft, so as to move linearly along the length of the lead screw upon rotation of the lead screw, wherein the output shaft moves the inner elongated tube into and out from said outer elongated tube upon activation of said motor such that a full extraction of the output shaft along the longitudinal axis will render the maximum height of the telescopic column, and a full retraction will render the minimum height of the telescopic column.

According to this embodiment, the motor being part of the driving unit mentioned earlier in the text, is the driving force providing rotary movement, which ultimately drives the inner tube between the minimum and maximum heights through the other components of the driving unit.

The motor being substantially arranged external to the telescopic column may significantly contribute to accessing a larger range of heights, as neither of its dimensions will add to the ultimate length of the column, making room for a lower minimum of the height range. The motor may, in this embodiment, be attached to the backside of the table top, adjacent to the column, so that the worm screw may reach the relevant components of the column, namely the worm wheel.

The worm wheel may be a hollow structure, devised so to accommodate the bearing sleeve attached within its inner side. Therefore, as the worm screw drives the worm wheel, both the worm wheel and the attached bearing sleeve will be rotated about the longitudinal axis. The sleeve bearing, having a hollow structure. May accommodate the lead screw within its hollow structure. The lead screw may be coupled to the bearing sleeve from a bottom end, and arranged to rotate as the bearing sleeve is rotated. The output shaft, which is in fact the member coupled to, and arranged to move the inner tube in a longitudinal direction, is coupled to the lead screw through the receiving nut from an end. As the lead screw is rotated, the nut will move along the groves of the lead screw, moving the output shaft up or down along the longitudinal axis.

In one embodiment the hollow bearing sleeve is arranged to enable further retraction of the output shaft by accommodating an ending portion of the lead screw and the output shaft when further retracted, within the hollow structure of the bearing sleeve.

This embodiment may allow the minimum height of the column to be lowered even further, giving access to a larger height range.

In one embodiment the bearing sleeve and the worm wheel are situated inside a housing positioned at the first end of the telescopic column, the housing arranged to further accommodate a portion of the lead screw, and the output shaft when output shaft is retracted.

Having these members accommodated within a housing will secure these components together and in place, while providing a better aesthetics. It is notable that, this housing may allow movement of the top end of the inner tube in and out of itself upon the contraction, and expansion strokes of the telescopic column, respectively. In addition, it may permit for accommodating other useful components within itself. Examples of such components are given in the following text.

In one embodiment the housing further comprises at least one axial bearing to decrease rotational friction of the bearing sleeve with rotation of the worm wheel.

The axial bearing may be arranged and positioned so to partially surround the worm wheel. It is necessary that, in this embodiment, the axial bearing allows access of the worm screw to the worm wheel from the non-surrounded portion. From the outer side, the axial bearing may be arranged to be fitted within the inner tube. Additionally, it may be arranged to be fitted within the outer tube when the column approaches its minimum height.

In one embodiment the housing further comprises at least one radial bearing, so to radially secure said bearing sleeve, and decrease friction upon rotation of said bearing sleeve relative to said worm wheel.

The radial bearing may be positioned and fixed on either side of the worm wheel along the longitudinal axis, and around the bearing sleeve attached to it from the inside. From the outside the radial bearing may be fitted within the inside of the axial bearing.

An embodiment with two radial bearings is preferable, each positioned on either side of the worm wheel in the longitudinal direction.

In another aspect of the present invention, a foot extension unit is provided. The extension unit may be used in foot for a table according to any of the above embodiments (with or without the telescopic column having an intermediate member). However, the extension unit does not have to be arranged in such a table, but may be a stand-alone component. But if the extension unit is combined with the table as described above, the synergetic effect is that the stroke length (i.e. length between the minimum and maximum height) of such table is further increased, and it is achieved with an inexpensive manner. Regardless of this, the foot comprises an extension unit adapted to be situated within an inner volume of the foot, and manually extendable under the foot parallel to the longitudinal axis, the extension unit comprising: a core shank positioned within the inner volume of the foot, and fixed from one end to the foot, the core shank comprising screw threads on an outer surface, a first extension socket, the first extension socket comprising first grooves on a first portion of an inner surface, the first grooves arranged to engage with the screw threads of the core shank and rotate about an axis parallel to the longitudinal axis, rendering rotatable extension and retraction of the first extension socket out from and into the hollow volume of the foot, respectively, the core shank being hollow, and adapted to receive a tool for exerting a rotation of the core shank relative to the first extension socket so as to adjust the total length extension of the extension unit.

This will provide for an even wider range of accessible heights for the table through increasing the maximum height of the table by the extendable length of the first extension socket.

The core shank preferably may extend for at least 90% of the entire height of the foot, and has grooves along at least 90% of its extension.

The tool accepting part of the core shank may be adapted to receive an allen, or other equivalent tool, in order to exert rotation by manually rotating the allen tool.

In one embodiment, the first extension socket of the extension unit further comprises second grooves on a second portion of the inner surface.

In one embodiment, the first grooves extend along 30%, 40%, 50%, 60%, or 70% of the grooved portion of the inner surface of the first extension socket, while the second groves extend along the other 70%, 60%, 50%, 40% or 30% of the grooved portion relative to one another.

In one embodiment, the extension unit of the foot further comprises:

a second extension socket, comprising grooves on a portion of an outer surface arranged to engage with the second grooves of the first extension socket and rotate about the longitudinal axis, rendering rotatable extension and retraction of the second extension socket out from and into the first extension socket, respectively.

This may allow for an even further increase of the accessible height range of the table by the extendable length of the second extension socket, and the extendable length of the first extension socket.

In one embodiment, the second grooves of the first extension socket comprise at least one different characteristic from the first grooves of the first extension socket.

The difference could be in the dimensions, such as: groove pitch, groove diameter, groove height, or in their rotational friction, or alternatively any combination of the latter mentioned characteristics.

In one embodiment, the first and second extension sockets have different rotational friction with the threads of the core shank, and the second grooves of the first extension socket, respectively, allowing for sequential activation of the extension sockets.

By this, it may be guaranteed that the extension sockets may be extended outwards in sequential order, rather than at the same time.

The extension socket with the lower relative rotational friction will be activated first upon the manual rotation of the tool, subsequently, when and after that extension socket is extended to its maximum extension, the other extension socket may be rotationally activated through the manual rotation of the tool.

It is notable that, it is not necessary that both extension sockets are extended, and that it is not necessary that they are extended to their maximum length, but the amount of extension may be adjusted by the user in order to obtain the desirable table height.

BRIEF DESCRIPTION OF DRAWINGS

Further details and aspect of the present invention will become apparent from the following detailed description with reference to accompanying drawings, in which:

FIG. 12*a-b* shows an extension unit with a single extension socket.

FIG. 15*a-b* an extension unit with a double extension socket at maximum extension.

DETAILED DESCRIPTION OF DRAWINGS

Figure 1A:
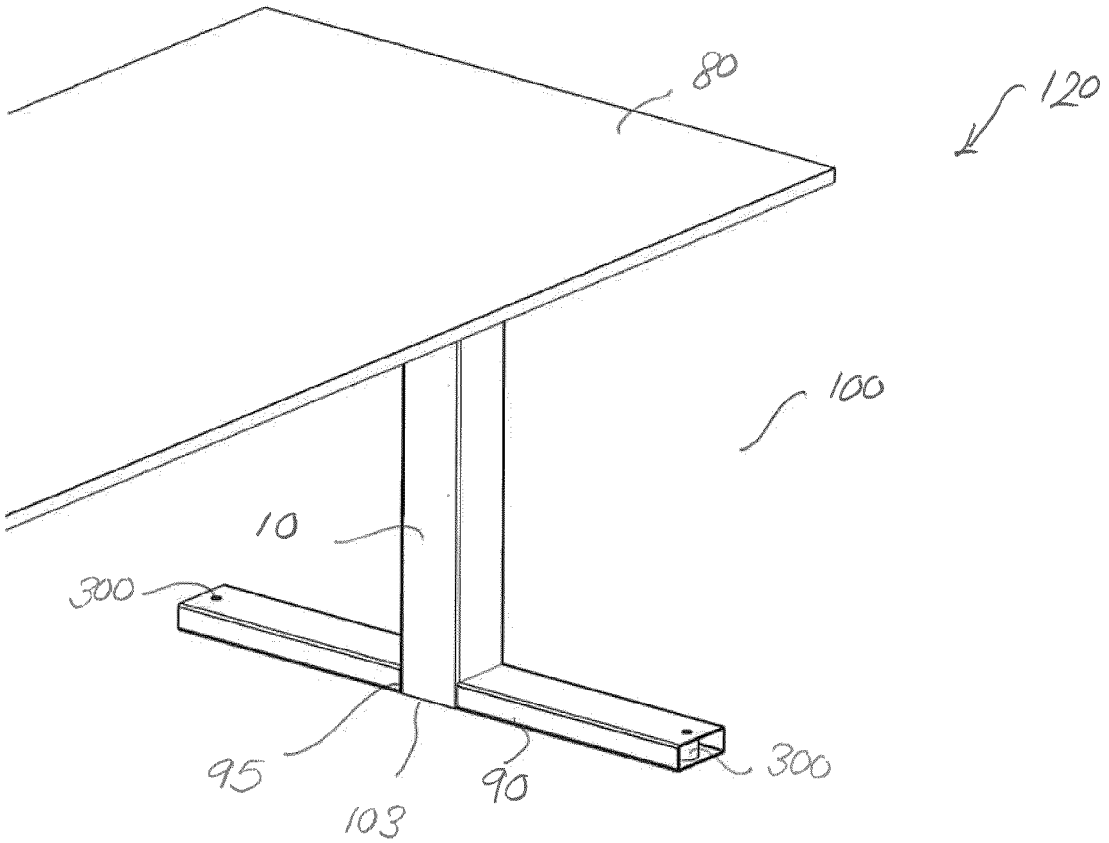
FIG. 1*a-d* shows a perspective overview of the telescopic column at its at its minimum position.

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person.

FIGS. 1 through 7 illustrate the different stages of a full expansion and contraction stroke of the telescopic column. In order to help the eye, and put the description in better context, the figures are drawn with reference to a height adjustable table wherein the leg comprises a telescopic column according to the present invention. It should however be noted that, the claims are not limited to the telescopic column with the accompanying table members. Instead, the sought protection is defined by the claims.

FIGS. 1*a*-1*d* demonstrates the telescopic column 100 at its minimum position 111. Note that the minimum height and minimum position both refer to the same notion, therefore are used interchangeably throughout the rest of the text, unless stated otherwise. Furthermore, the latter notion holds for the maximum height and maximum position as well. Additionally, the minimum 111, and maximum 112 heights are defined in relation to a Cartesian coordinate system, where the longitudinal axis of the telescopic column 100 corresponds and is parallel to the y-axis of said coordinate system. The point of origin is defined as the minimum position 111 of the telescopic column, and the maximum position 112 will then be in the first quadrant of the x-y plane of said coordinate system.

FIG. 1*a* depicts a portion of a height adjustable table 120 at the minimum height 111, wherein the leg is comprised of a telescopic column 100 according to the present invention. The telescopic column is attached to the under-side of the table top 80 from the top end 22 of the inner tube 20 (not shown).

Figure 1B:
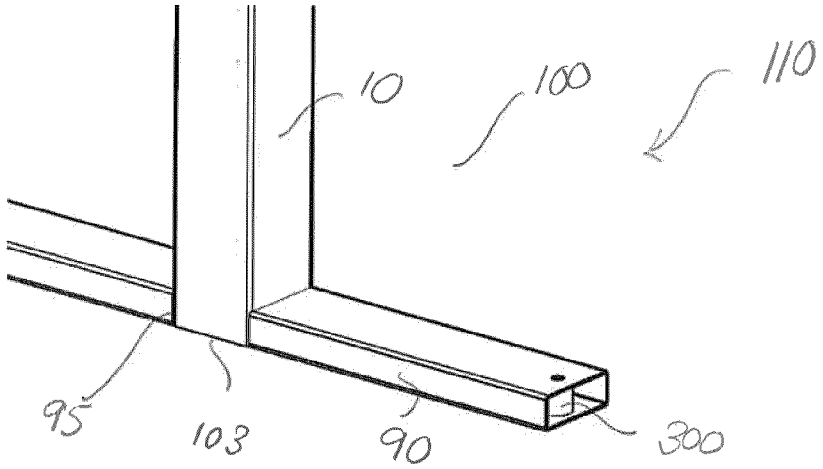
Figure 1C:
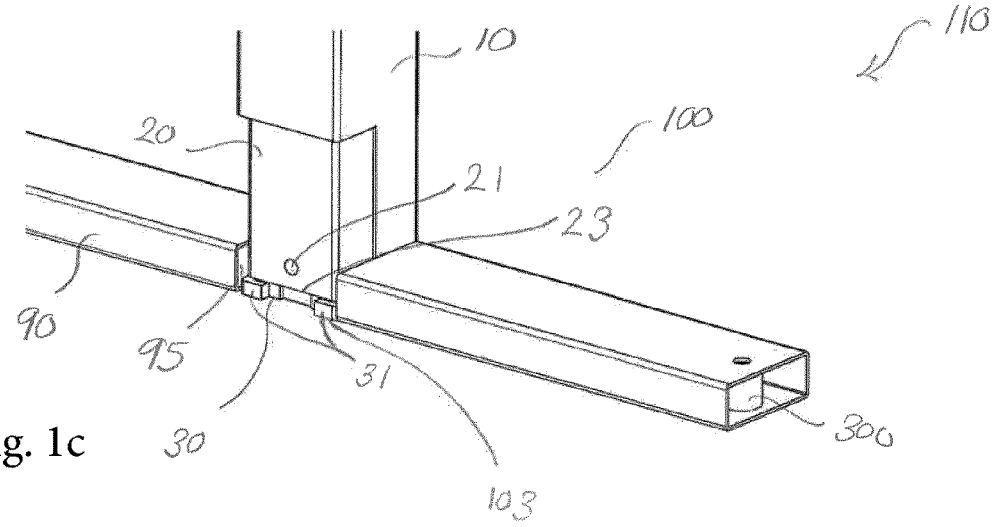

FIGS. 1*b* and 1*c* show close-up views of the lower part of the telescopic column 100 and the foot element 90 of the table 120. In FIG. 1*a* the outer tube 10 of the telescopic column 100 can be seen positioned within the cavity 95 of the foot element 90 of the table 120. An extension unit 300 is visible on either sides of the foot element 90. These extension units may assist the user to gain an even wider range of accessible heights of the table 120. The extension unit 300 is described in more detail further in the text and in relation to FIGS. 12*a*-15*b*.

The bottom of the outer tube 10 defines the second end 103 of the telescopic column 100. FIG. 1*c* illustrates a view wherein a portion of the outer tube 10 is removed, so as to expose the inner tube 20, and the intermediate element 30. As can be seen, at the minimum position 111 of the telescopic column 100, the inner tube 20, and consequently the intermediate element 30 are sitting at the bottom-most position of the telescopic column, within the cavity 95 of the foot element 90. The lower portion 31 of the intermediate element 30 is protruding from the periphery of the bottom end 23 of the inner tube 20. The lower portion 31 of the intermediate element is arranged and sized to fit and engage with the inner side of the outer tube 10.

Figure 1D:
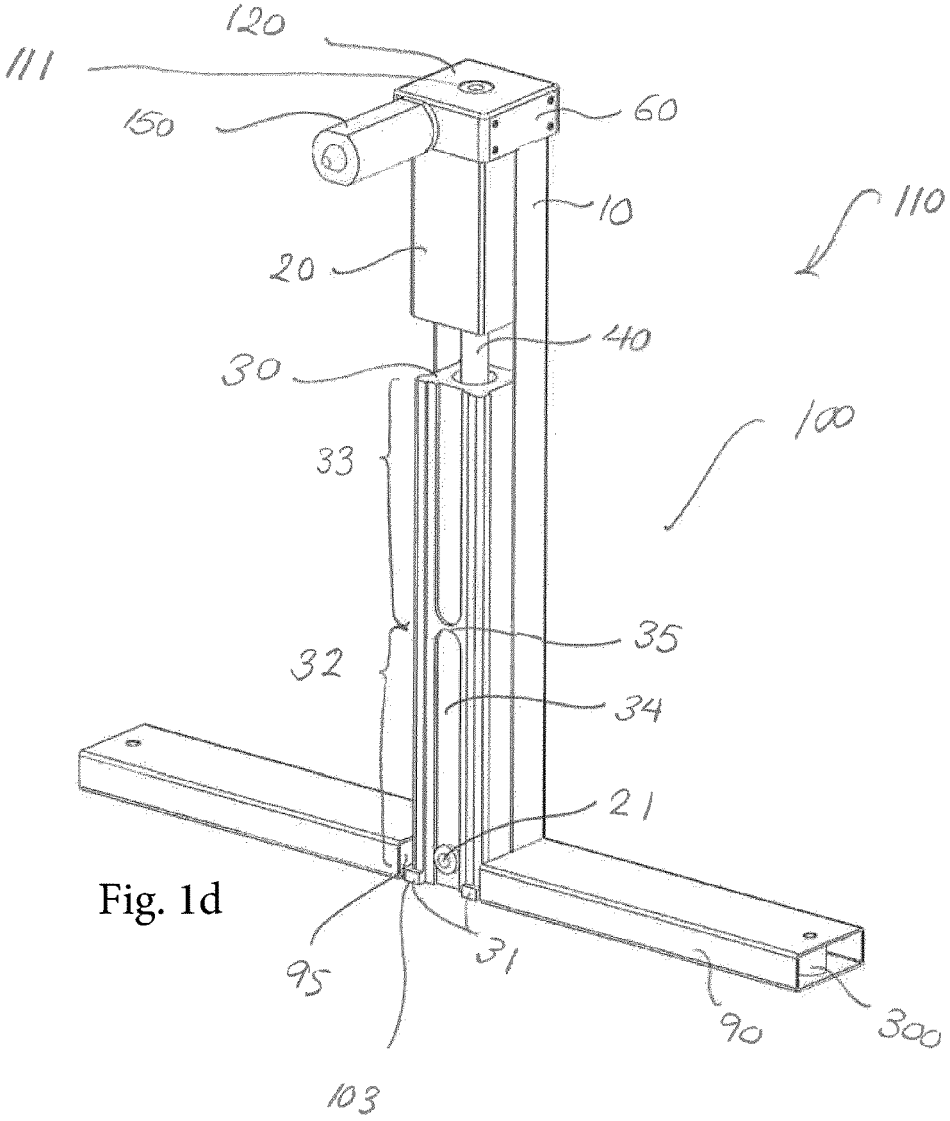

FIG. 1*d* 110, shows the telescopic column 100 at the minimum height 111, adjusted within the cavity 95 of the foot element 90 of the table 120, while the table top 80 is excluded so to provide a view of the top end 22 of the inner tube 20 which determines the first end 102 of the telescopic column. The table top 80 would be positioned above, and attached to the top end 22 of the inner tube 20. A motor 150 can be seen arranged at the upper portion of the inner tube 20, which is sitting in a housing 60. The motor 150 is part of a driving unit 200 (not shown), which is utilized for driving the inner tube 20 between the minimum 111 and maximum 112 heights of the column. The driving unit 200 is described in extensive detail later in the text. As observed from the figure, the top end of the inner tube 20 and the outer tube 10 are accommodated within the housing 60.

In the view of FIG. 1*d*, the outer tube 10, and the inner tube 20 have been partially removed in order to expose the intermediate element 30, and a portion of an output shaft 40, which is part of the driving unit 200 (not shown). The intermediate element 30, comprises a lower portion 31, which is sized and adapted to engage the outer tube 10 from the inside, a middle portion 32 being sized and adapted to be fitted into the inner tube 20 and engage the inner tube 20 from the inside, and an upper portion 33 being sized and adapted to be remain within the inner tube 20, so as to provide for stability. The intermediate element further has an engaging element 35 which defines the ending of the middle portion 32, and the beginning of the upper portion 33, and is arranged to engage with the engaging portion 21 of the inner tube 20 during a second stage of the expansion stroke, i.e. when the inner tube 20 is engaged with the intermediate element 30, and is passively moving the intermediate element 30 with itself during the expansion stroke of the telescopic column 100. The intermediate element further comprises a groove 34 along the length of the middle portion 32, which is devised to accommodate the movement of the engaging portion 21 of the inner tube along itself during a first stage of the expansion stroke; i.e. when inner tube 20 is moving outwards from the outer tube 10, but is not yet engaged with the intermediate element 30, hence the intermediate element 30 is stationary, and a first stage of the contraction stroke of the telescopic column 100, i.e. when the inner tube 20 is moving inwards to the outer tube 10, but the bottom end 23 of the inner tube 20 has not yet reached and engaged the lower portion 31 of the intermediate element, so the intermediate element 30 is stationary.

Figure 2A:
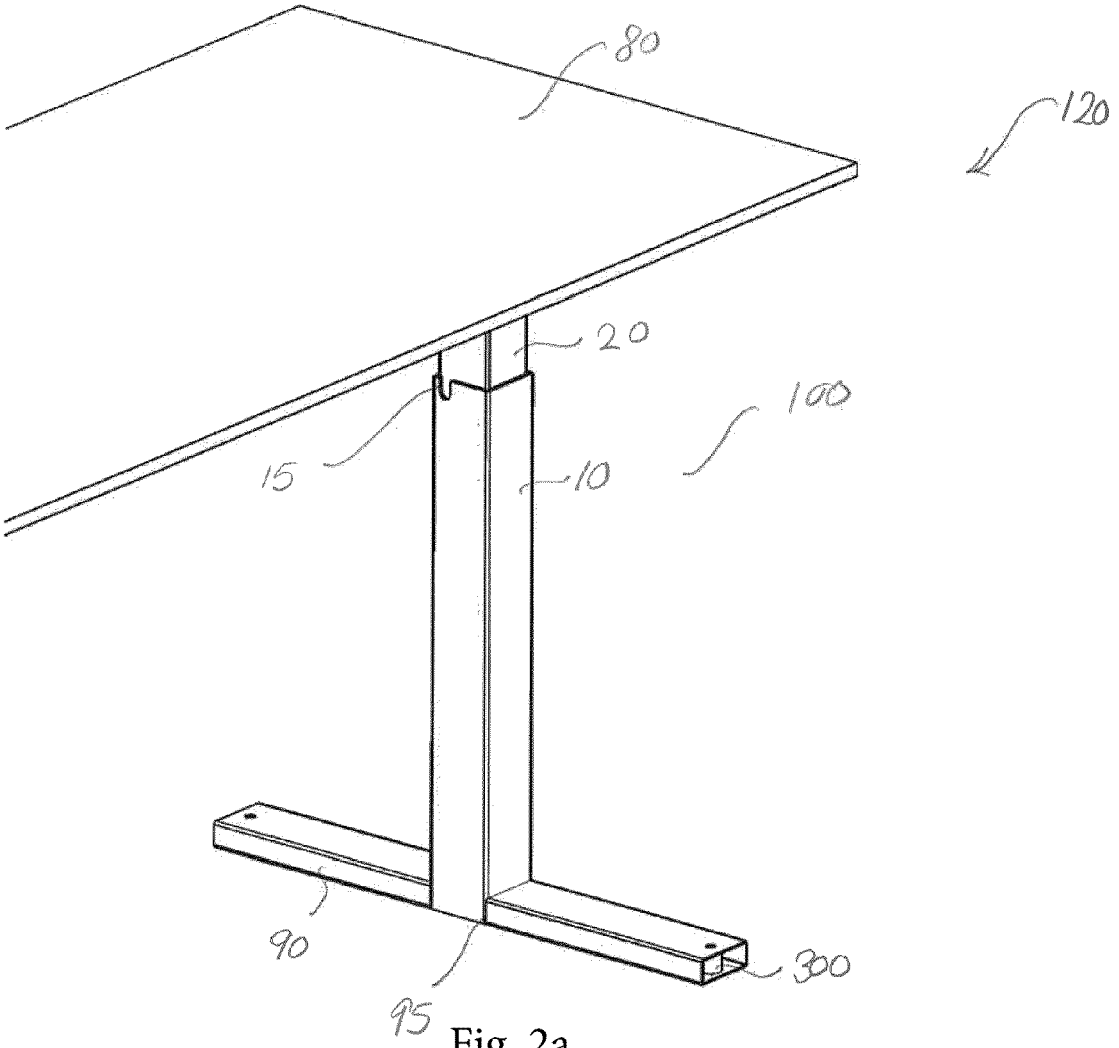
FIG. 2*a-c* schematically illustrates the first stage of the expansion stroke of the telescopic column.
Figure 2B:
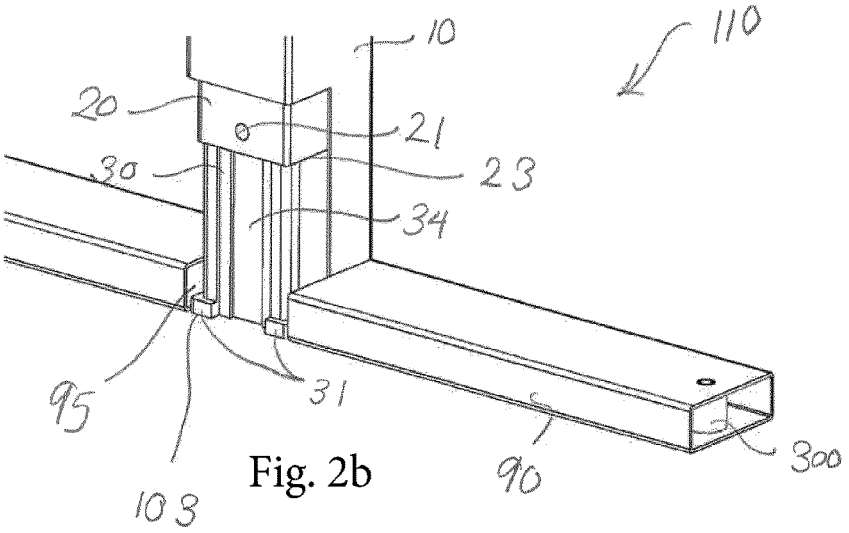
Figure 2C:
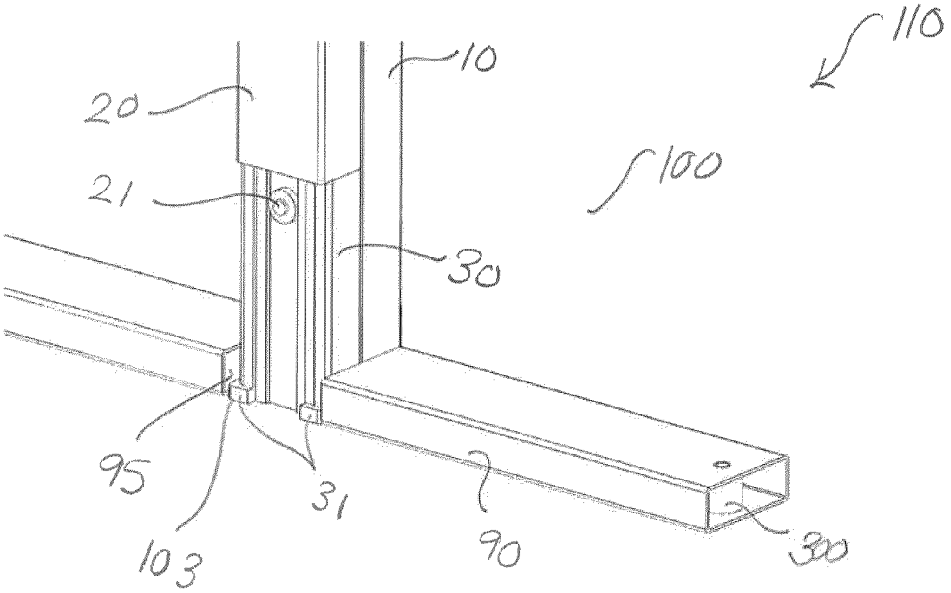

FIGS. 2*a*-2*c* schematically illustrates the first stage of the expansion stroke. As mentioned above, this stage is defined as when inner tube 20 is moving outwards from the outer tube 10, but its engaging element 21 is not yet engaged with the engaging portion 35 of the intermediate element 30, rendering the intermediate element 30 is stationary.

FIG. 2*a* depicts a portion of a height adjustable table 120 during the first stage of the expansion stroke, wherein the leg comprises a telescopic column 100 according to the present invention. The telescopic column is attached to the under-side of the table top 80 from the top end 22 of the inner tube 20 (not shown). A recess 15 is visible on the top end of the outer tube 10, which is devised for accepting a worm screw 156 of the driving unit 200 (not shown) when the telescopic column 100 is at its minimum height 111.

FIGS. 2*b* and 2*c* show close-up views of the lower part of the telescopic column 100 and the foot element 90 of the table 120. In the view of FIG. 2*b* the outer tube 10 is partially removed to expose the inner tube 20 and the intermediate element 30. It can be seen that, while the inner tube 20 has moved upwards (outwards from the outer tube 10) relative to its position in FIG. 1, the intermediate element 30 is stationary, and still sitting at the bottom end 103 of the telescopic column 100, within the cavity 95 of the foot element 90. FIG. 2*c* demonstrates a view in which a side wall of the inner tube 20 is partially removed so to expose the engaging portion 21 of the inner tube 20 positioned within the groove 34 of the intermediate element 30. The engaging portion 21 is devised to move within this groove 34 in the first stage of the expansion stroke, so to provide for smooth motion.

Figure 3A:
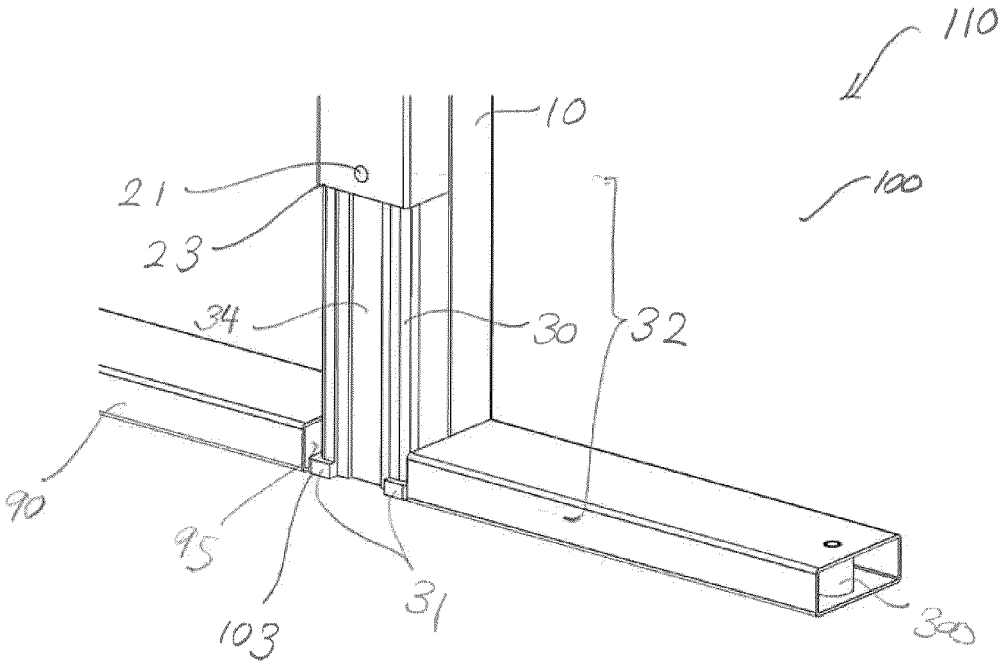
FIG. 3*a-b* demonstrates the engaging portion of the inner tube engaging with the engaging element of the intermediate element during the expansion stroke.
Figure 3B:
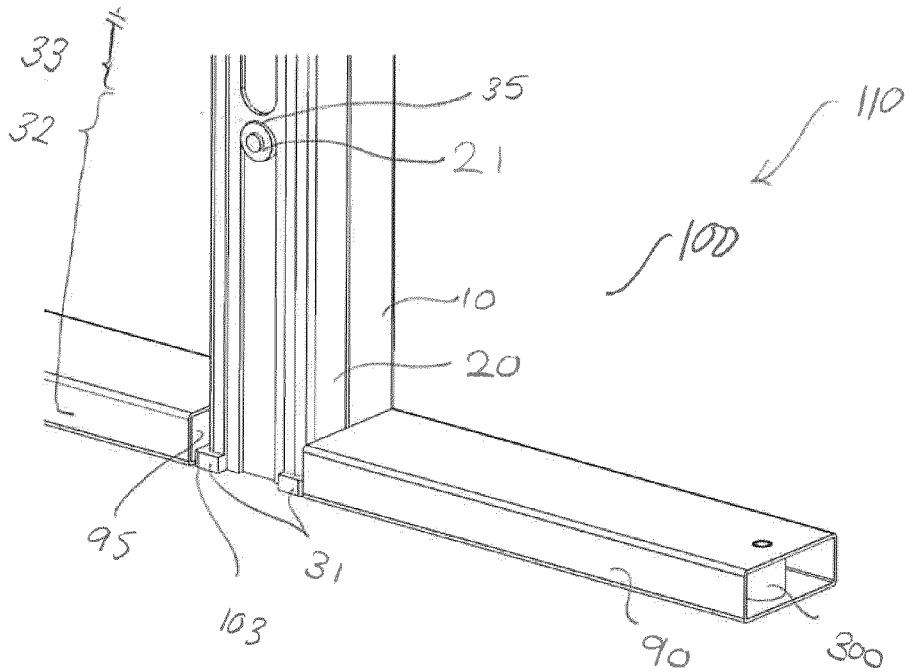

FIGS. 3*a*-3*b* demonstrates the moment of the expansion stroke of the telescopic column 100 in which the engaging portion 21 of the inner tube engages with the corresponding engaging element 35 of the intermediate element 30. FIG. 3*a* shows a close-up view of the lower portion of the table 120 where the telescopic column 100 and the foot element 90 can be partially seen. In the view of FIG. 3*a*, the outer tube is partially removed, so to expose the bottom end 23 of the inner tube 20 and the intermediate element 30. At this moment, while the lower portion 31 of the intermediate element still sits at the bottom end 103 of the telescopic column 100, and so is stationary, the full length of the middle portion 32 resides outside the inner tube 20, since the engaging portion of 21 the inner tube 20 is now engaged with the engaging element 35 of the intermediate element 30. This is better observable from the view provided in FIG. 3*b*, in which a side wall of the inner tube 20 is removed to provide a perspective of the engagement of the engaging element 35 of the intermediate element 30, and the engaging portion 21 of the inner tube 20. In FIG. 3*b*, the upper portion 33 of the intermediate element 30 is also partially observable. This upper portion 33 will always reside within the inner tube 20, no matter at which stage of the expansion or contraction stroke the telescopic column 100 is.

Figure 4A:
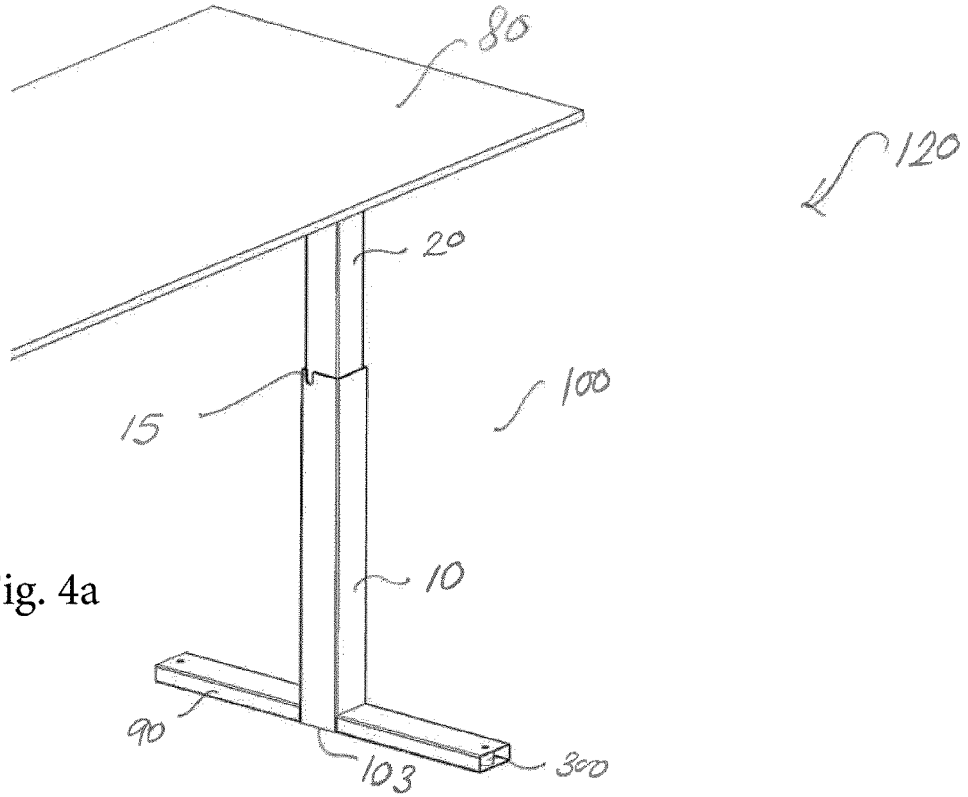
FIG. 4*a-b* illustrates the second stage of the expansion stroke.
Figure 4B:
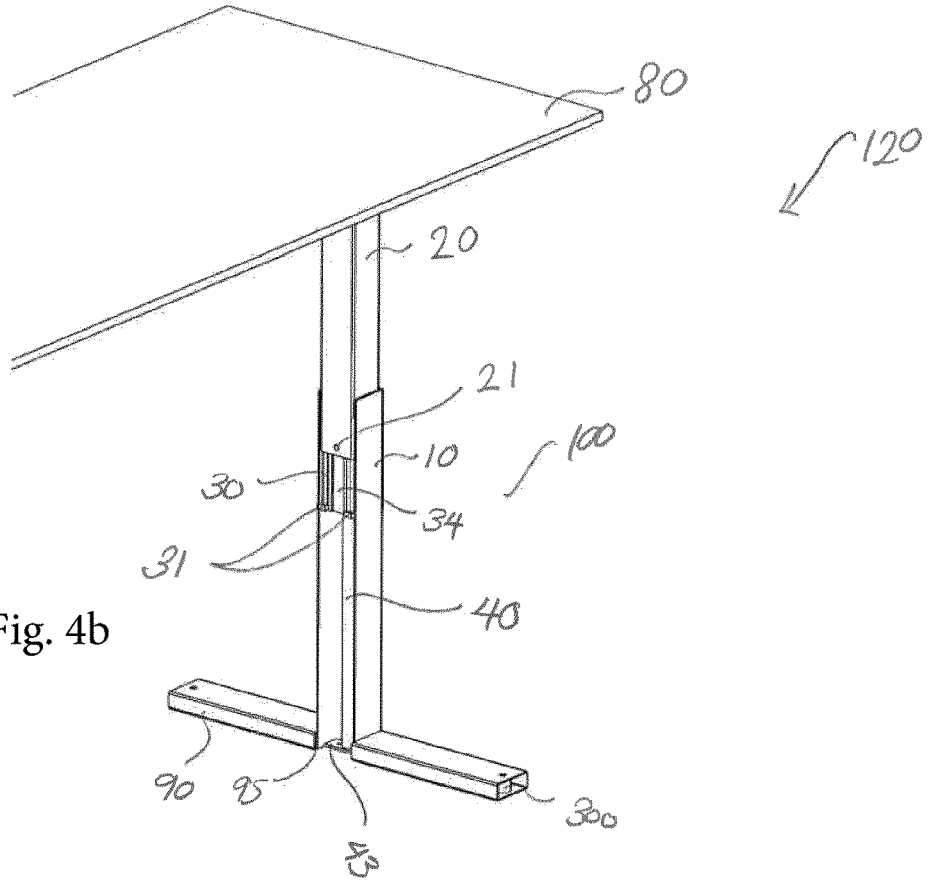

FIG. 4 illustrates the second stage of the expansion stroke. As mentioned above, this stage is defined as when the inner tube 20 is engaged with the engaging element 35 of the intermediate element 30 through its engaging portion 21, and is passively moving the intermediate element 30 with itself during the expansion stroke of the telescopic column 100. FIG. 4*a* depicts a portion of a height adjustable table 120 during the second stage of the expansion stroke, wherein the leg is comprised of a telescopic column 100 according to the present invention. The telescopic column is attached to the under-side of the table top 80 from the top end 22 of the inner tube 20 (not shown). A recess 15 is visible on the top end of the outer tube 10, which is devised for accepting a worm screw 156 of the driving unit 200 (not shown) when the telescopic column 100 is at its minimum height 111. FIG. 4*b* demonstrates the same view as in FIG. 4*a*, except a side wall of the outer tube 10 being removed, so to expose the bottom end 23 of the inner tube 20, and the lower 31 and middle 32 portions of the intermediate element 30. As visible, the intermediate element 30 has been passively moved upwards (outwards from the outer tube 10) by the inner tube 20. It can be understood that, during this stage of the expansion stroke, the intermediate element 30 is no longer stationary.

FIG. 5 illustrates the telescopic column 100 at its maximum position 112. FIGS. 5*a* and 5*b* depict a portion of a height adjustable table 120 at the maximum height 112, wherein the leg is comprised of a telescopic column 100 according to the present invention. The telescopic column is attached to the under-side of the table top 80 from the top end 22 of the inner tube 20 (not shown). The bottom end of the outer tube 10 is defining the second end of the telescopic column 100 can be seen positioned within the cavity 95 of the foot element 90. The worm screw 156 (not shown) accepting recess 15 of the outer tube 10 is also visible in FIG. 5*a*. In FIG. 5*b* a side wall of the outer tube 10 is removed, so to expose the bottom end 23 of the inner tube 20, and the intermediate element 30. FIG. 5*c* shows a close-up view of the boxed portion of the telescopic column 100 of FIG. 5*b*. as seen from FIGS. 5*b* and 5*c*, the entire length of the middle portion 32 of the intermediate element 30 resides outside the inner tube 20. As observable, the overlap $p_1$ of the inner 20 and outer tubes 10 at this stage is very small relative to the total length L of the telescopic column 100. As the length of the overlap increases the length of the telescopic column in its minimum height, and/or, decreases the length of the telescopic column in its maximum height, it is desirable to have as small overlap P1 as possible, preferably less than 20% of the length, 15% of the length, 10% of the length 5% of the length or as little as 2% of the length or less.

Figure 5A:
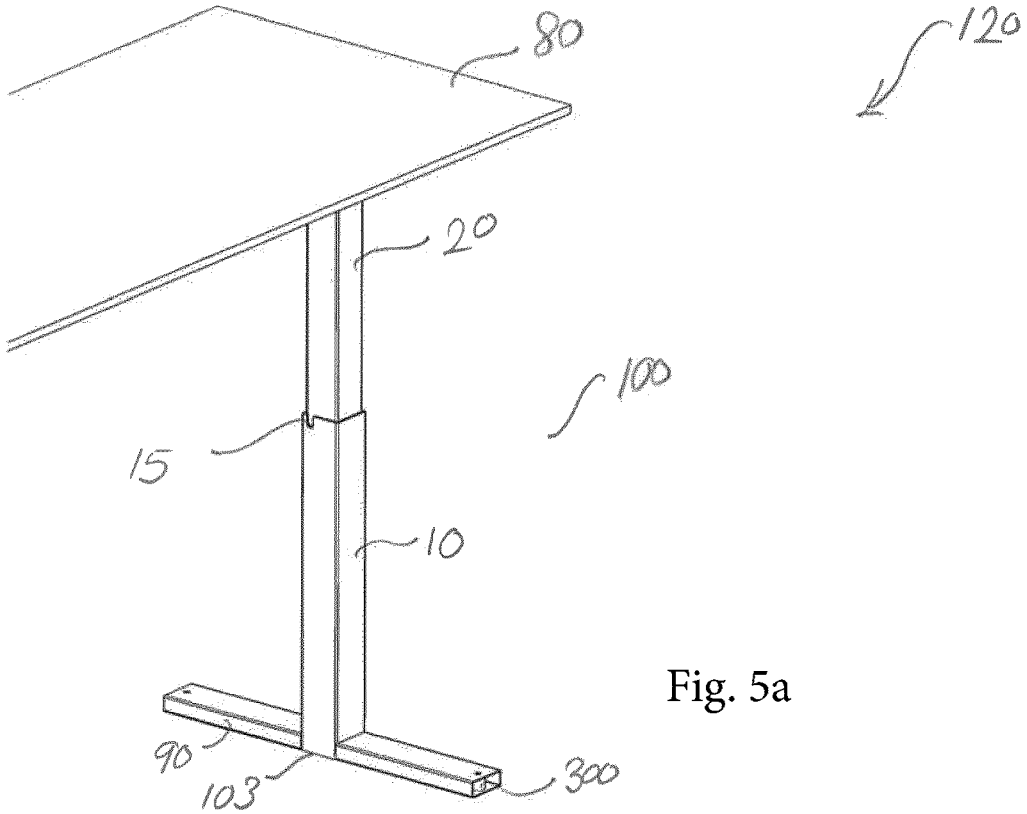
FIG. 5*a-d* illustrates the telescopic column at its maximum position.
Figure 5B:
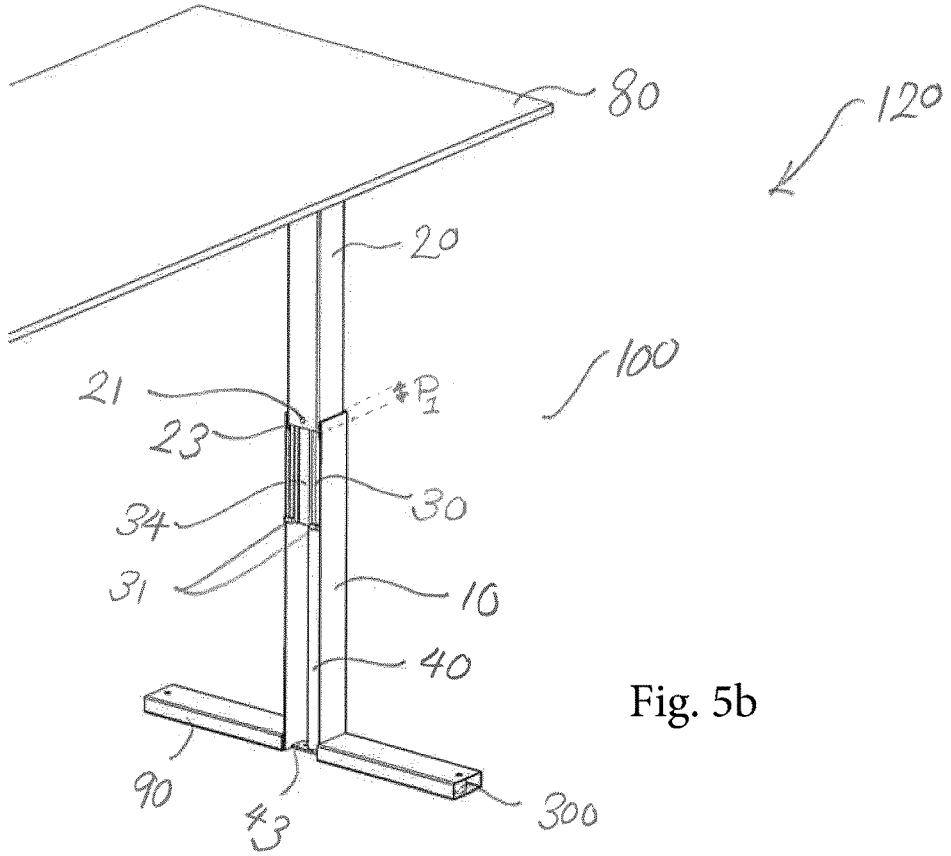
Figure 5C:
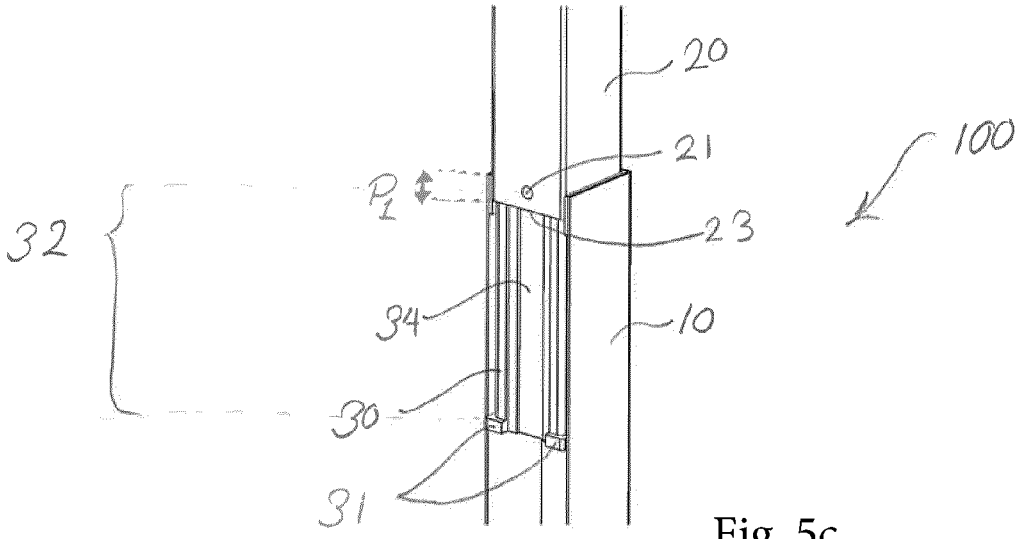
Figure 5D:
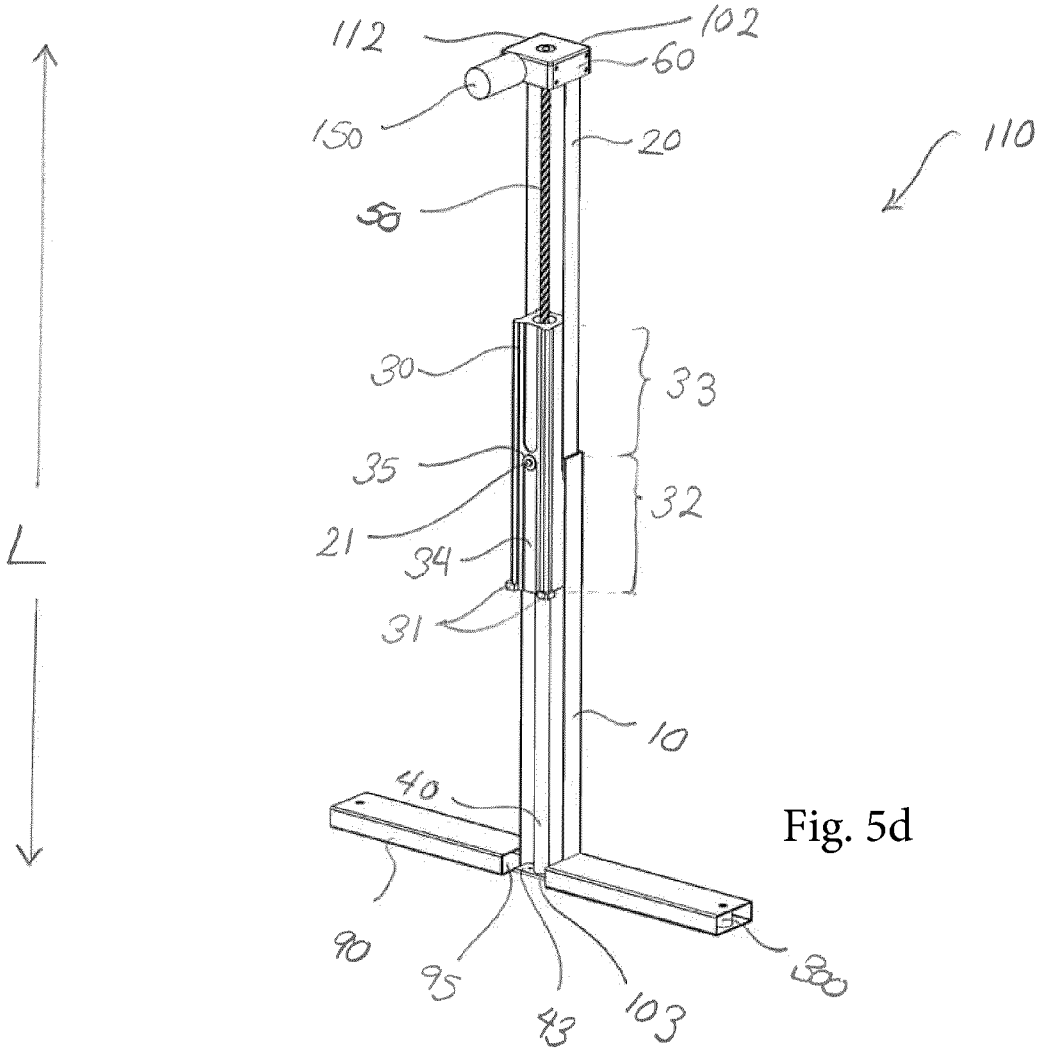

FIG. 5*d* shows the telescopic column 100 at the maximum height 112, adjusted within the cavity 95 of the foot element 90 of the table 120, while the table top 80 is excluded so to provide a view of the top end 22 of the inner tube 20 which determines the first end 102 of the telescopic column. The table top 80 would be positioned above, and attached to the top end 22 of the inner tube 20. The motor 150 can be seen arranged at the upper portion of the inner tube 20, which is sitting in the housing 60. In the view of FIG. 5*d*, a side wall of the outer tube 10 and a portion of the inner tube 20 have been removed so to give a perspective of the entire intermediate element 30, the output shaft 40, and a portion of a lead screw 50. The lead screw 50 is also a component of the driving unit 200, and will be explained in better detail in further in the text. As observed in this figure, the engaging portion 21 of the inner tube 20 and the engaging element 35 of the intermediate element 30 are engaged, and are positioned at the top-most portion of the interior of the outer tube 10, and the bottom-most portion of the interior of the inner tube 20. The upper portion 33 of the intermediate element 30 as mentioned earlier, will always reside within the inner tube 20 to provide for stability. Also, the lower portion 31, which is sized and adapted to engage the outer tube 10 from the inside, is frictionally engaged with the inner walls of the outer tube 10.

FIG. 6 schematically demonstrates the first stage of the contraction stroke of the telescopic column 100. As mentioned above, this stage is defined as when the inner tube 20 is moving inwards to the outer tube 10, but the bottom end 23 of the inner tube 20 has not yet reached, nor engaged the lower portion 31 of the intermediate element 30, rendering the intermediate element 30 stationary. During the first stage of the contraction stroke the lower portion 31 of the intermediate element 30 is maintained stationary by frictional engagement with the inner walls of the outer tube 10.

Figure 6A:
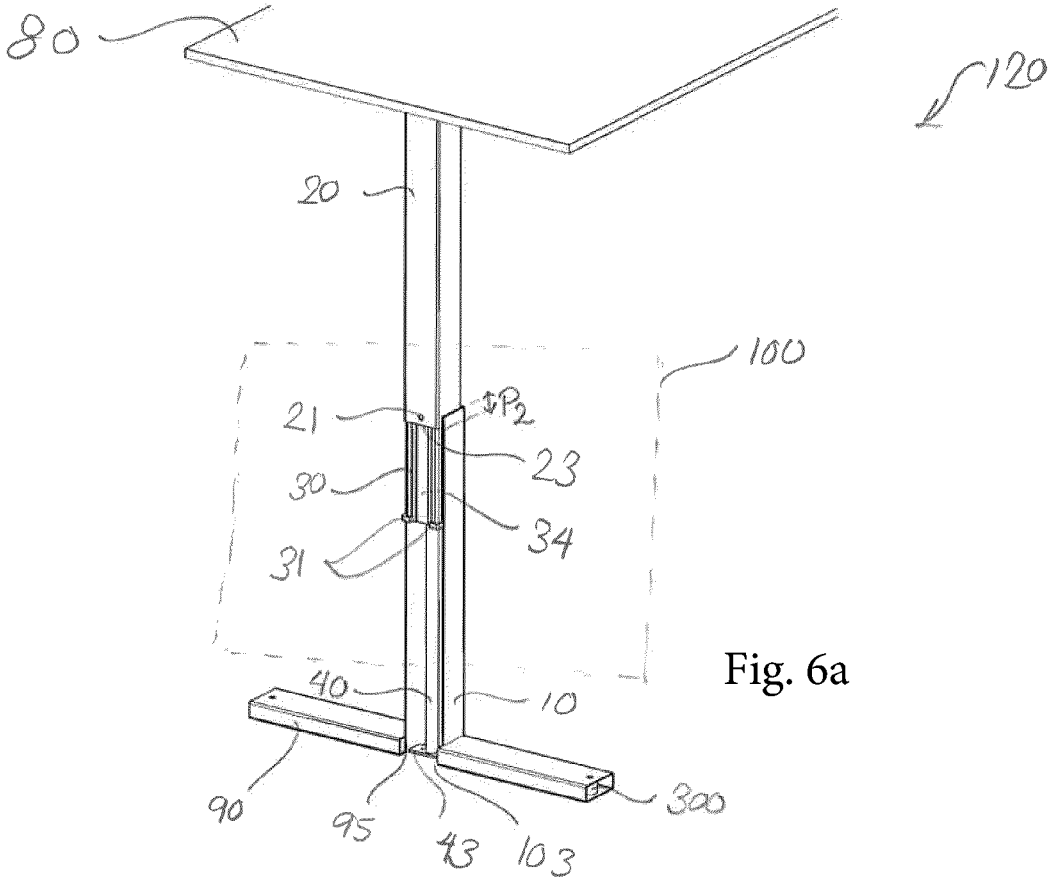
FIG. 6*a-b* schematically demonstrates the first stage of the contraction stroke of the telescopic column.
Figure 6B:
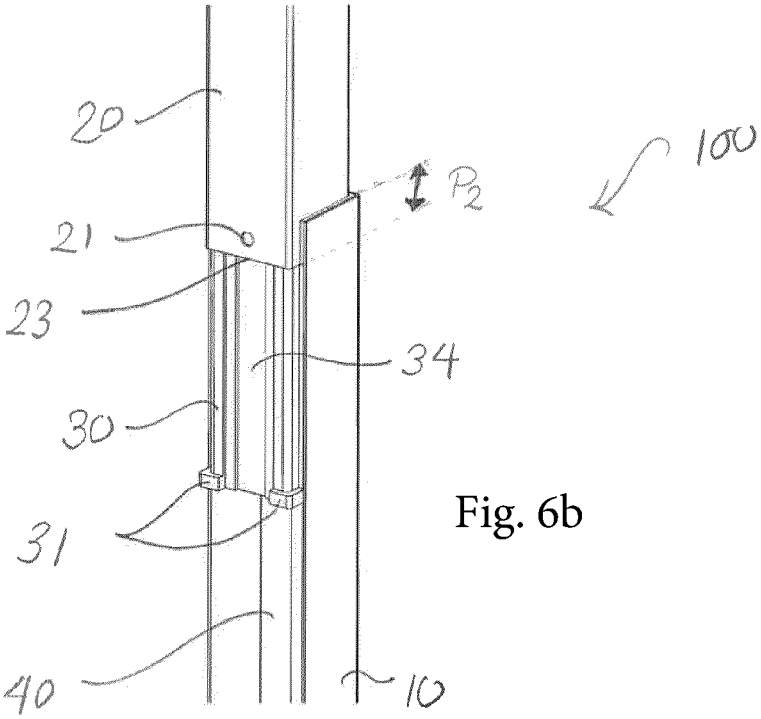

FIG. 6*a* depicts a portion of a height adjustable table 120 during the first stage of the contraction stroke, wherein the leg is comprised of a telescopic column 100 according to the present invention. The telescopic column is attached to the under-side of the table top 80 from the top end 22 of the inner tube 20 (not shown), and the bottom end of the outer tube 10, which defines the second end 103 of the telescopic column 100 is within the cavity 95 of the foot element 90. FIG. 6*b* is a close-up view of the boxed portion of the telescopic column 100 marked in FIG. 6*a*. A side wall of the outer tube is removed in both FIGS. 6*a* and 6*b*, so to expose the bottom end 23 of the inner tube 20, the intermediate element 30, and a portion of the output shaft 40. As visible from these figures, and as a result of the inner tube 20 moving downwards (inwards into the outer tube 10), the overlap $p_2$ of the inner 20, and outer tubes 10 is larger in comparison to the overlap $p_1$ of the latter mentioned members at the maximum height 112 of the telescopic column 100, shown in FIG. 5. A smaller portion of the middle portion 32 of the intermediate element 30 is remains exterior to the inner tube 20 compared to that at the maximum position 112 of the telescopic column 100 due to the downwards movement of the inner tube 20, over the middle portion 32 of the intermediate element 30. The engaging portion 21 of the inner tube 20 will move within the groove 34 of the intermediate element 30 during the first stage of the contraction stroke.

FIG. 7 depicts the final stage of the movement of the telescopic column 100, namely the second stage of the contraction stroke. This stage is defined as when the inner tube 20 is moving inwards to the outer tube 10, and is engaged with the lower portion 31 of the intermediate element 30 through its bottom end 23, and is passively moving the intermediate element 30 with itself during the contraction stroke of the telescopic column 100.

Figure 7A:
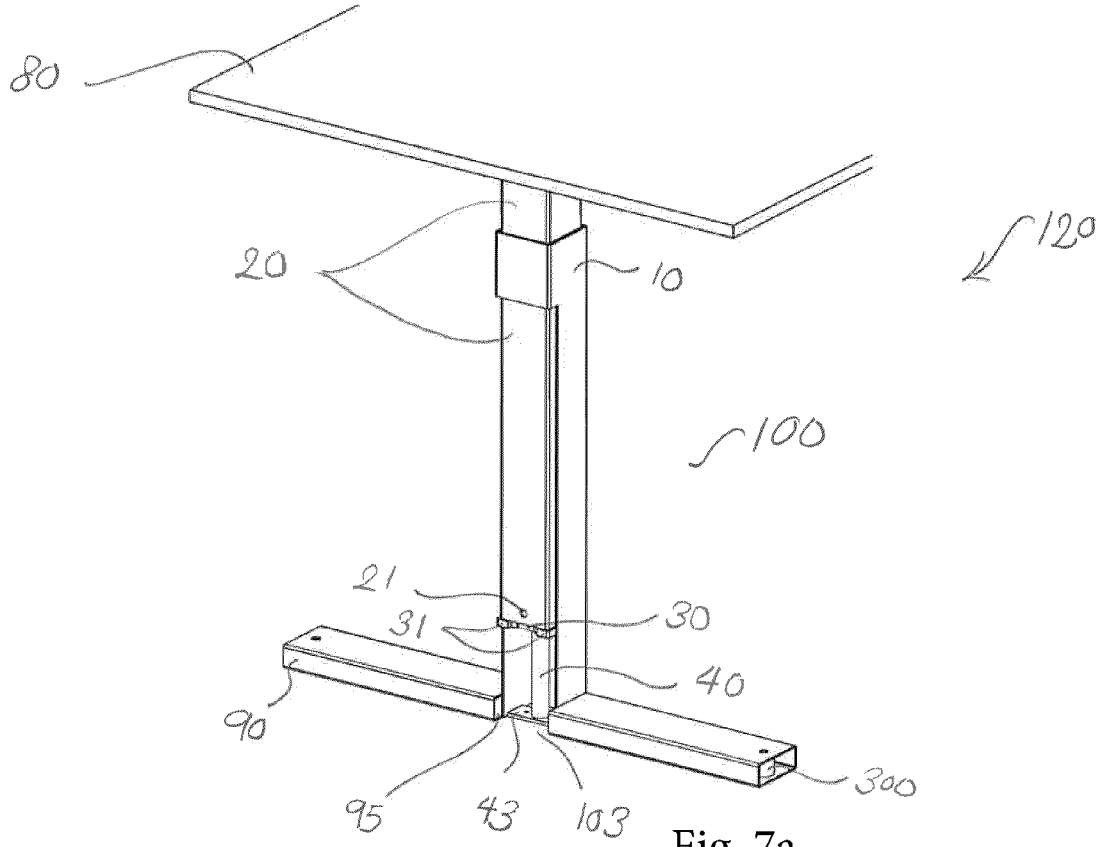
FIG. 7*a-b* depicts the second stage of the contraction stroke.
Figure 7B:
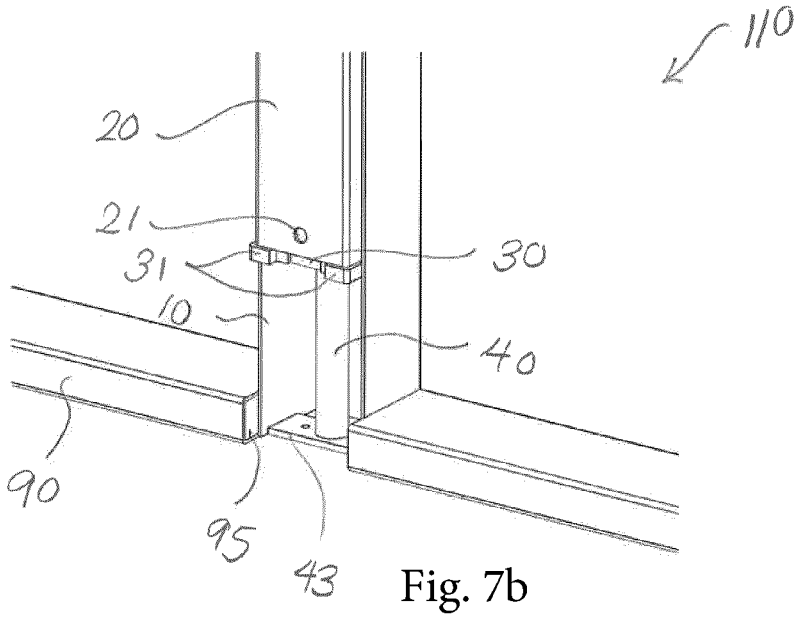

FIG. 7*a* depicts a portion of a height adjustable table 120 during the second stage of the contraction stroke, wherein the leg is comprised of a telescopic column 100 according to the present invention. The telescopic column is attached to the under-side of the table top 80 from the top end 22 of the inner tube 20 (not shown). A portion of the outer tube 10 is removed in the view of FIG. 7*a*, so to show the portion of the inner tube 20 that resides within the outer tube 10 at this stage, the lower portion 31 of the intermediate element 30 located under, and protruding from the periphery of the bottom end 23 of the inner tube 20, and a portion of the output shaft 40. As observable form this figure, an upper portion of the inner tube 20 remains exterior to the outer tube, as the telescopic column 100 is yet to reach its minimum height 111 at the end of the contraction stroke. FIG. 7*b* shows a close-up view of the lower part of the telescopic column 100 and the foot element 90 of the table 120. In the view of FIG. 2*b* the outer tube 10 is partially removed to expose the inner tube 20 and the intermediate element 30.

Figure 8:
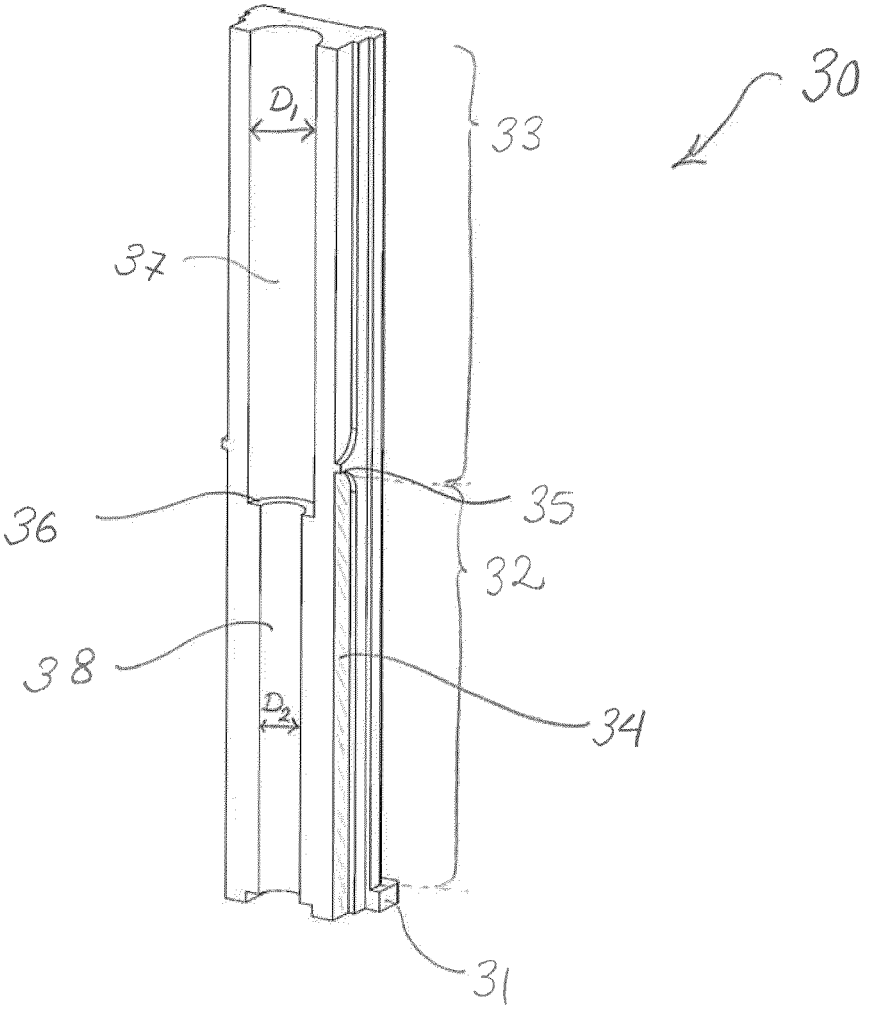
FIG. 8 shows a cross sectional perspective view of the intermediate element.

FIG. 8 schematically shows a cross sectional perspective view of the intermediate element 30. As observed, the interior of the intermediate element 30 is hollow, comprising two sections; namely the first interior hollow 37, and the second interior hollow 38 of the intermediate element 30. The hollow structure of the intermediate element 30, is devised to accommodate the output shaft 40 and/or the lead screw 50. The first interior hollow 37 has a cross sectional diameter $D_1$, which is larger than the cross sectional diameter $D_2$ of the second interior hollow 38. The onset of the second interior hollow 38 from the first 37 is defined by the top edge 36 of the second interior hollow 38. This top edge 36 serves the purpose of an end stop for the intermediate element 30, similar to a physical barrier, so to hinder the intermediate element from moving further out in the expansion stroke. Hence forth, the top edge 36 will be referred to as the physical barrier. The stopping mechanism of the physical barrier 36 is explained with respect to FIG. 9 as follows.

FIG. 9 demonstrates the telescopic column 100, and the relative positions of the intermediate element with respect to the output shaft 40 and the lead screw 50. FIG. 9*a* shows a view in which a side wall of the outer tube 10, and the inner tube 20 are removed so to expose the intermediate element 30, the output shaft 40, and the lead screw 50. The mechanisms of the driving unit are described in detail later in the text, but in brief, the lead screw 50 translates rotational movement to longitudinal movement of the output shaft 40. The output shaft 40 in turn is coupled to the inner tube 20, and drives the inner tube 20 outwards from, and inwards to the outer tube 10 during the expansion and contraction strokes of the telescopic column 100, respectively.

Figure 9A:
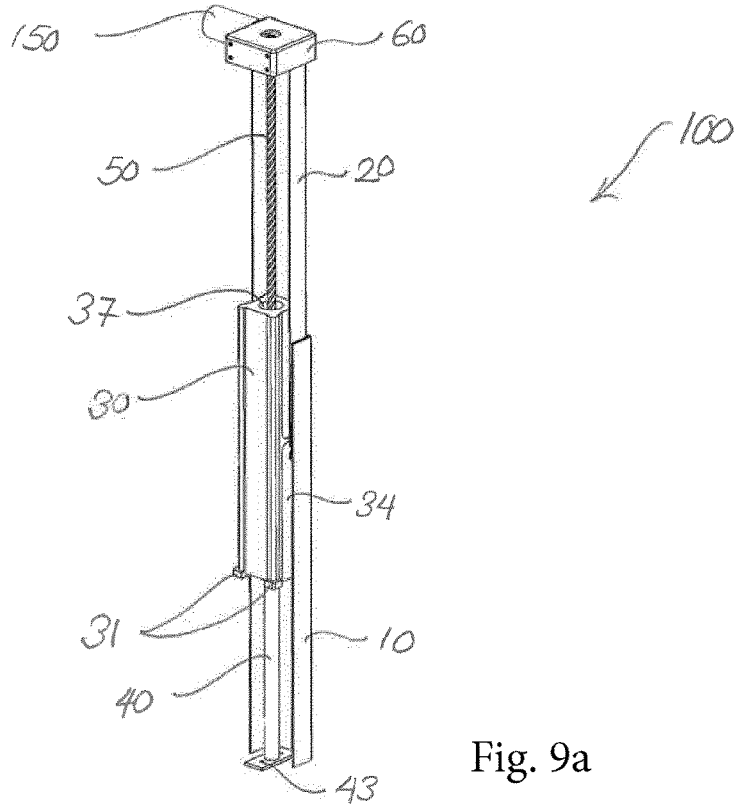
FIG. 9*a-d* show the relative positions of the intermediate element of the telescopic column with respect to the output shaft and the lead screw.
Figure 9B:
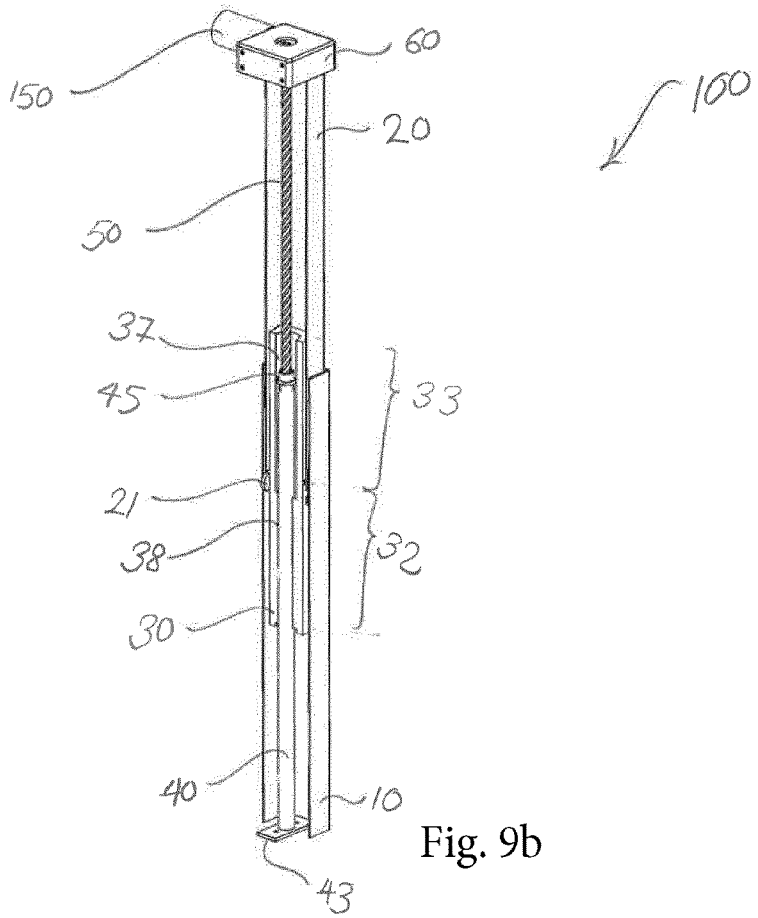
Figure 9C:
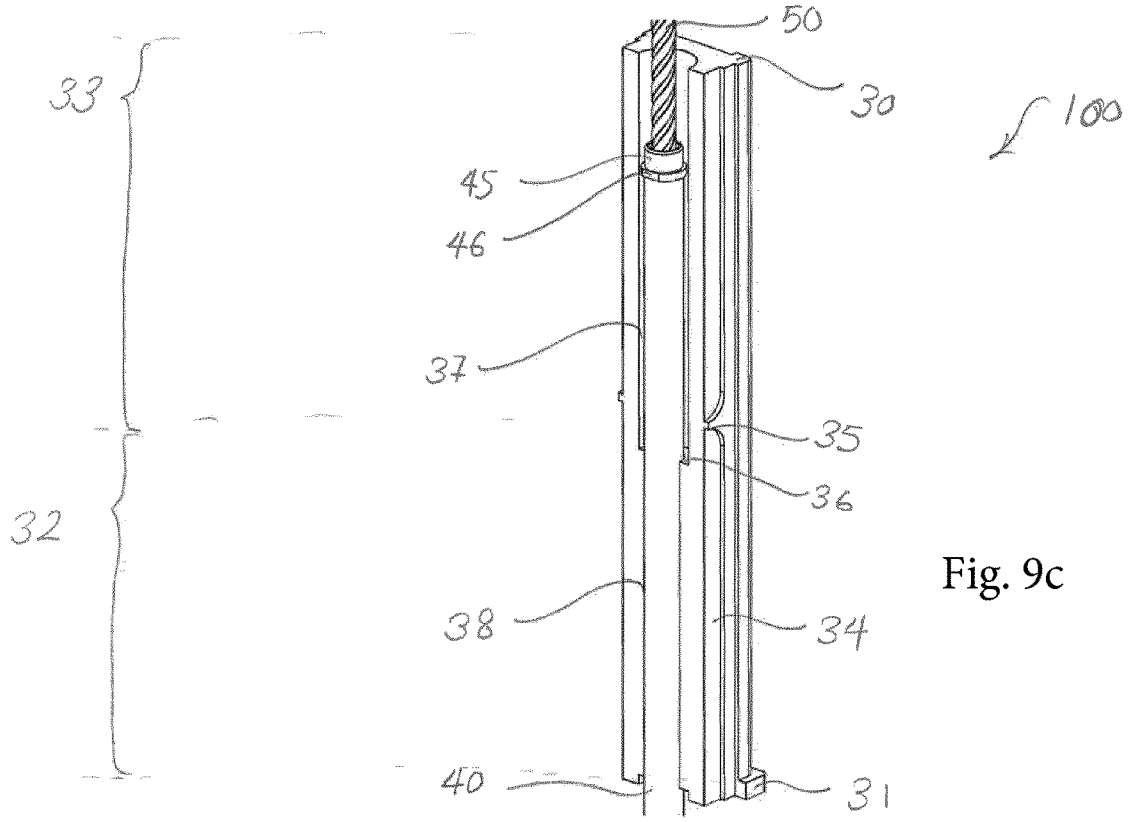
Figure 9D:
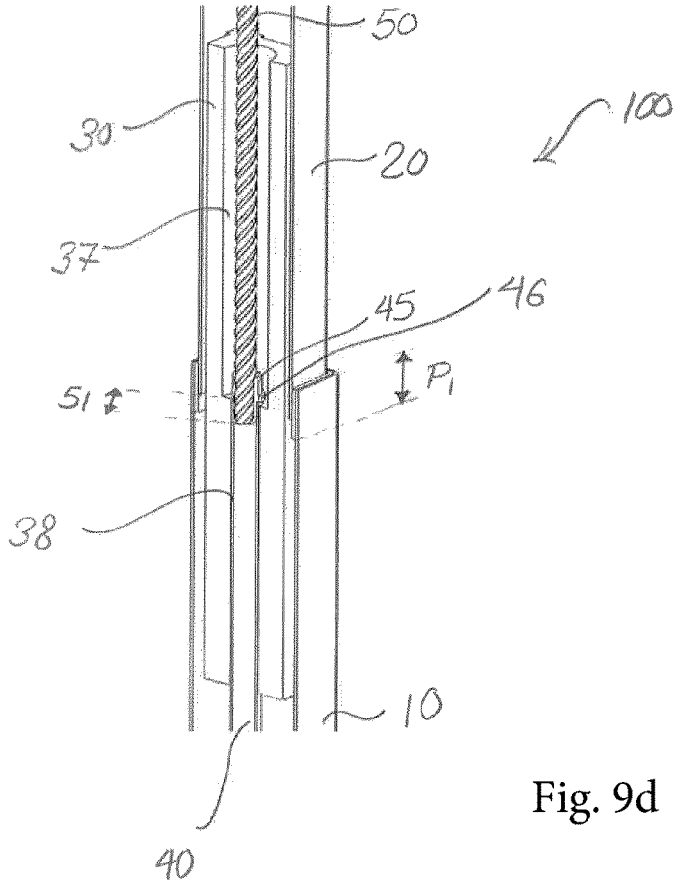

In FIG. 9*a* the opening of the first interior hollow 37 of the intermediate element 30 can be seen through which the lead screw 50 is penetrating. The output shaft 40 exits the intermediate element 30 from an opening of the second hollow 38 (not shown), from the other end. FIG. 9*b* shows the same view as FIG. 9*a*, except that the intermediate element 30 is partially removed so to expose the portions of the output shaft 40, and the lead screw 50 that are within the intermediate element 30. On the top of the output shaft 40, and coupling it to the lead screw 50, a receiving nut 45 is situated. FIG. 9*c* shows a close-up view of a portion of the telescopic column in FIG. 9*b*, wherein the entire length of the intermediate element, and portions of the output shaft 40 and lead screw 50 are visible. In addition, in FIG. 9*c*, the outer tube 10 and the inner tube 20 are completely removed from the picture. Focusing on the inner side of the intermediate element 30, the first interior hollow 37, the second interior hollow 38, and the physical barrier 36 is visible. While the lead screw 50 is within the first interior hollow 37, the output shaft 40 is well within the first interior hollow 37, tailing into the second interior hollow 38 of the intermediate element 30. This is due to the column being somewhere midway between its minimum 111 and maximum 112 heights, as indicated by the positioning of the inner tube 20 relative to the outer tube 10 in FIGS. 9*a* and 9*b*. Furthermore, from FIG. 9*c*, it can be seen that the receiving nut 45 of the output shaft 40 comprises a lower protrusion 46 with a slightly larger cross sectional diameter than that of the output shaft 40. The diameter of this protrusion 46 is larger than the diameter $D_2$ of the second interior hollow 38 of the intermediate element 30. This is so that when in the expansion stroke, the protrusion 46 will hit against the physical barrier 36 of the intermediate element 30, thus hindering the intermediate element 30 from moving further out in the telescopic column 100. This situation is depicted in FIG. 9*d*, where a cross sectional perspective close-up view of the telescopic column 100 is given. It is notable that, as observed in this figure, a portion 51 of the lead screw 50 well extends within the output shaft 40. However, one must note that, this portion of the lead screw 51 may never exit the output shaft 40, as FIG. 9*d* demonstrates the maximum height 112 of the telescopic column 100. Thus, when it is said that "the lead screw does not extend inside the second hollow 38 of the intermediate element 30", it is only meant to refer to that portion of the lead screw 50, excluding portion 51.

In FIGS. 10 and 11 the mechanism of the driving unit 200 will be extensively explained. Note that, in all these figures, as better seen in FIG. 10*a*, an upside-down view of the table 120, and thus the telescopic column 120, and the driving unit 200, is given.

FIG. 10 displays the telescopic column 100, and the driving unit 200 when the telescopic column 100 is somewhere midway between its minimum 111 and maximum 112 heights. This is visible from the relative positioning of the outer 10 and inner 20 tubes, also the receiving nut 45 of the output shaft 40 (more explanation given below). As observable in FIG. 10*a*, the table 120 is upside down, displaying underneath the table top 80. A breadth fastening bar 81, and two length fastening bars 82 help fasten the telescopic column 100 and the driving unit 200 to the under-side of the table top 80, through the housing 60. In FIG. 10*b*, a portion of the outer tube 10 and inner tube, as well as the entirety of the intermediate element 30 have been removed so to provide a better view of the output shaft 40 and the lead screw 50. It is observed that, the lead screw 50 is penetrated within a bearing sleeve 70, into the housing 60. The receiving nut 45 of the output shaft 40 is well outside the bearing sleeve 70, which is an indication of the telescopic column 100 not being at its minimum height 111.

Figure 10A:
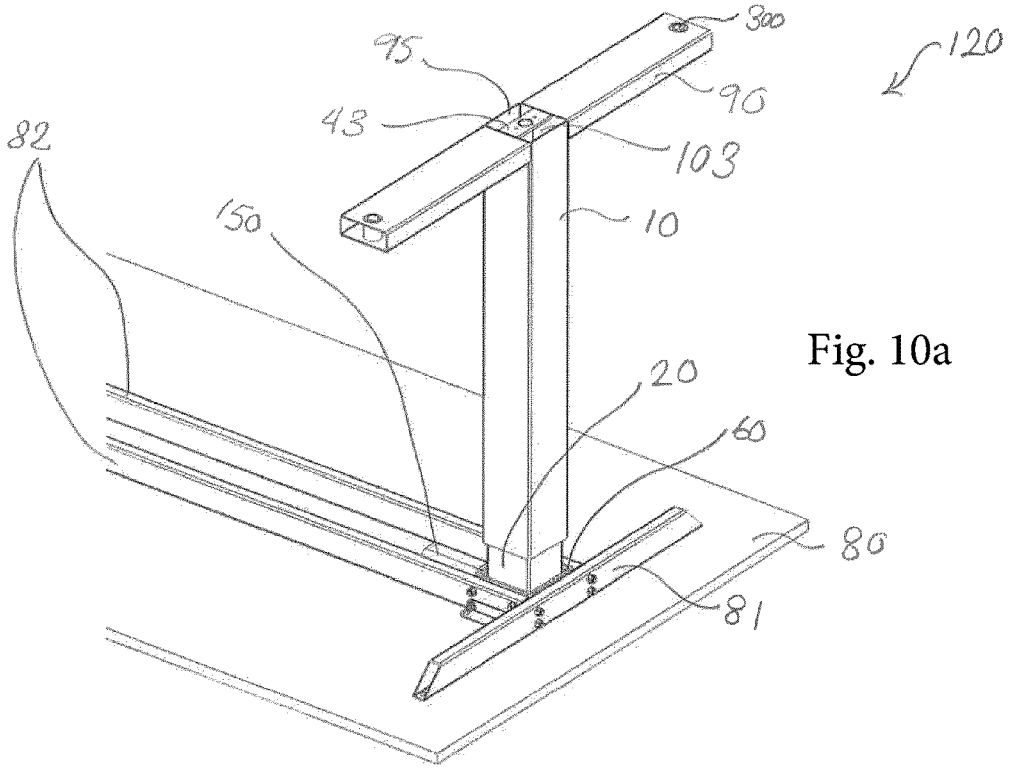
FIG. 10*a-d* displays the telescopic column, and the driving unit.
Figure 10B:
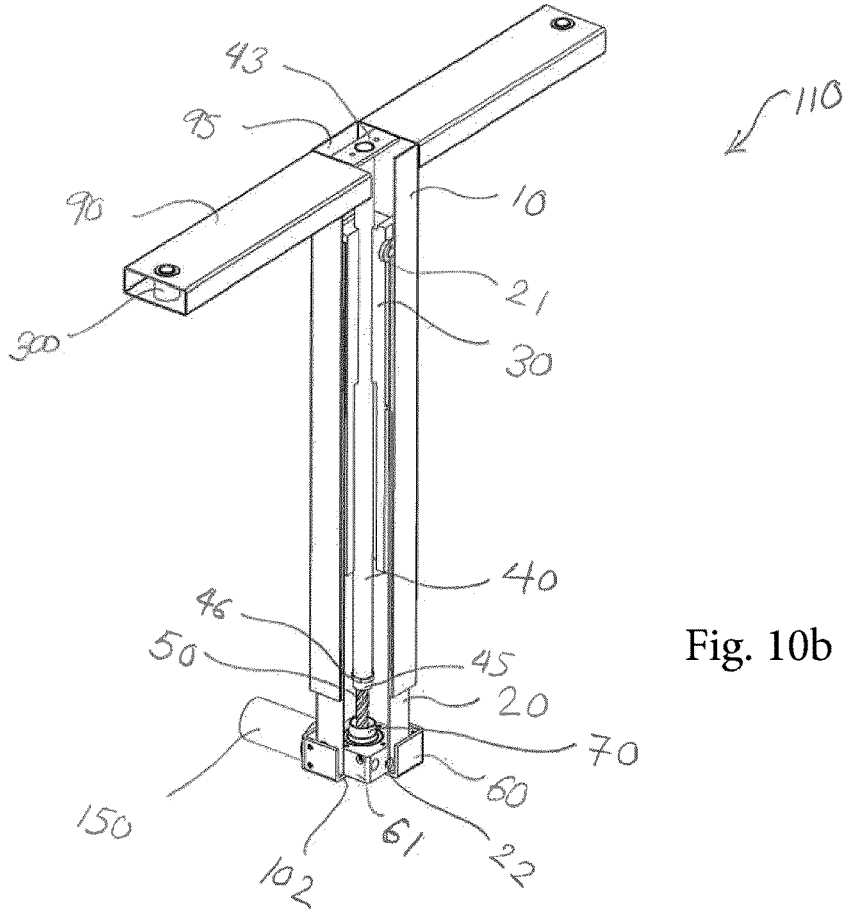
Figure 10C:
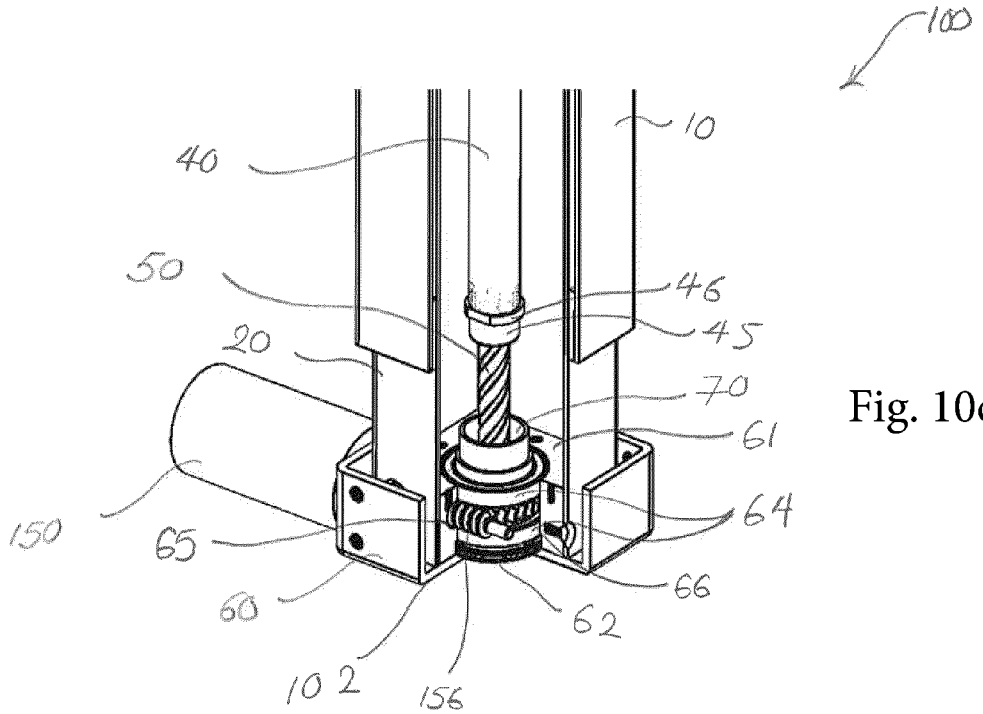
Figure 10D:
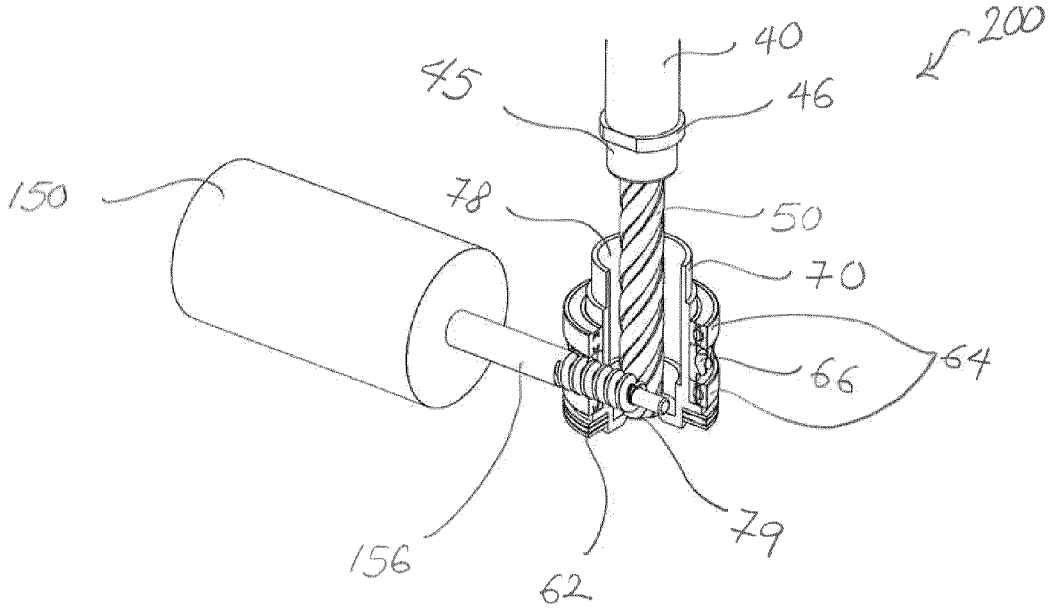

FIG. 10*c* illustrates a close-up view of the top portion of the telescopic column 100, wherein a portion of the outer tube 10, inner tube 20, and the housing 60 are removed to give a better view of the components of the driving unit 200 situated within the housing 60, additional to the lead screw 50, and the output shaft 40. FIG. 10*d* demonstrates a view of the driving unit 200 while excluding the housing 60, and the outer 10 and inner tubes 20. From FIGS. 10*c* and 10*d* it can be understood that, the worm screw 156 is attached from one end to the motor 150, the housing 60, the inner holder 61 of the housing 60, inner tube 20, and in the case of approximately minimum height 111 of the telescopic column, the outer tube 10, from a recess (65, 25—not shown, 15—not shown) devised the receive the other end of the worm screw 156. Depending on whether the column 100 is desired to expand or contract, the worm screw 156 is configured to rotate in either rotary direction driven by the motor 150. The worm wheel 156 will then transfer this rotary movement to a worm wheel 66, arranged and attached around the bearing sleeve 70. As the worm wheel 66 rotates about the longitudinal axis, it will rotate the bearing sleeve 70 about the longitudinal axis together with itself. From FIG. 10*d* it is observable that the lead screw 50 is attached from an end 79 to the bearing sleeve 70. The lead screw 50 is rotatable along the longitudinal axis, and as the bearing sleeve 70 rotates, it will rotate the lead screw 50 together with itself. The lead screw 50 in turn, is coupled with the output shaft 40 through the receiving nut 45. The output shaft 40 is fixed to the second end 103 of the telescopic column from the other end by a fixation 43. Note that, this fixation 43 keeps the output shaft 40 rigidly attached to the second end 103 of the column 100, not allowing for any separation of movement. As the lead screw 50 rotates, the inner threads (not shown) of the receiving nut 45 interact with the grooves on the lead screw 50. By this, the rotary movement of the lead screw 50 is translated to longitudinal movement of the output shaft 40 along the longitudinal axis, allowing for height adjustment of the table 120 comprising a telescopic column 100 according to the present invention.

In addition, FIGS. 10*c* and 10*d* demonstrate two radial bearings 64 fitted and attached to the bearing sleeve 70, and surrounding either sides of the worm wheel 66. The radial bearings 64 serve the purpose of radially securing the bearing sleeve 70, and decreasing rotational friction upon rotation of the bearing sleeve 70 relative to the worm wheel 66. Furthermore, in FIG. 10*c* an inner holder 61 is also visible attached to the inner side of the housing 60, and fitted to surround the radial bearings 64, and the worm wheel 66. Additionally, an axial bearing 62 is attachably fitted between the housing 60 and a radial bearing 64. The axial bearing is meant to decrease rotational friction of the bearing sleeve 70 with rotation of the worm wheel. It is necessary that, in this embodiment, the inner holder 61 of the housing 60 allows access of the worm screw 156 to the worm wheel 66 from the non-surrounded portion. From the outer side, the inner holder 61 is arranged to be fitted within the inner tube 20, and additionally the outer tube 10 when the column 100 approaches its minimum height 111.

As mentioned earlier, in the illustrations of FIG. 10, the telescopic column 100 is not at its minimum height 111. This is observable from the location of the receiving nut 45 of the output shaft 40 on the lead screw 50. In the embodiment demonstrated here, for increasing the range of accessible heights of the telescopic column 100 even further, the bearing sleeve 70, is configured to have a hollow structure, so as to be able to accommodate the receiving nut 45, and a portion of the output shaft 40 within its hollow 78. This is to facilitate decreasing the height of the telescopic column 100 even further, therefore allowing for lower minimum heights to be achieved.

Figure 11A:
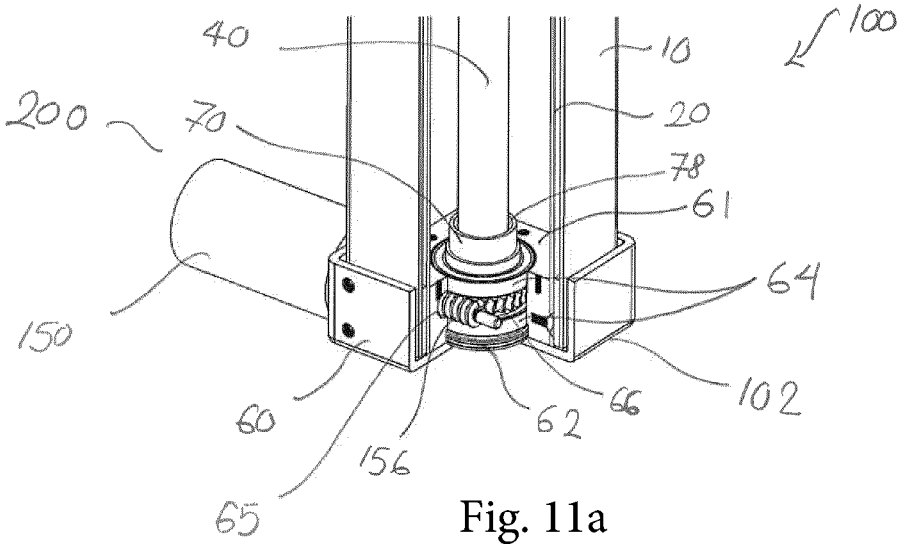
FIG. 11*a-c* shows the telescopic column and the driving unit at the minimum height.
Figure 11B:
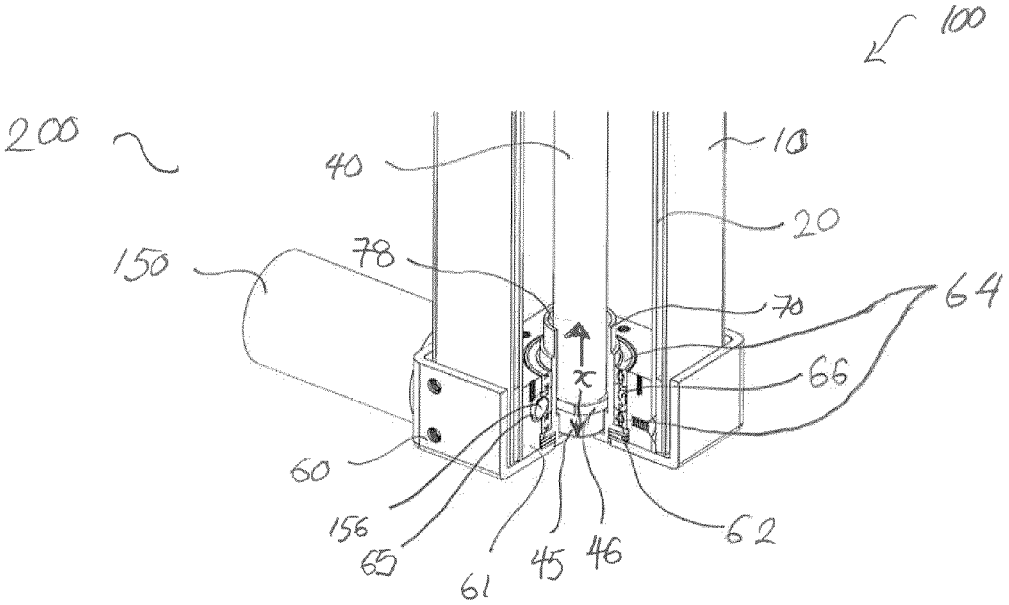
Figure 11C:
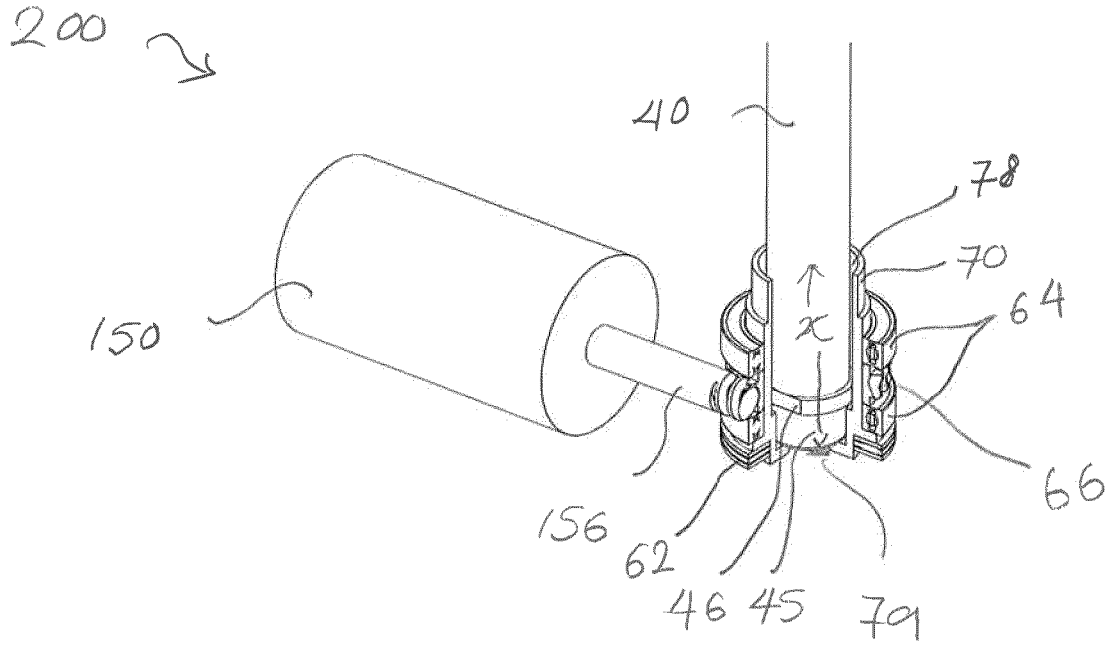

The latter situation is schematically demonstrated in FIG. 11, where the telescopic column 100 and the driving unit 200 are shown at the minimum height 111 of the telescopic column 100. In FIG. 11*a* the first end 102 of the telescopic column 100 is shown wherein the housing 60, the inner tube 20, the outer tube 10, and the inner holder 61 are partially removed so to expose the worm screw 156, the worm wheel 66, the radial bearings 64, a portion of the bearing sleeve 70, and the output shaft 40. The receiving nut 45, nor the lead screw 50 is visible in this position, as they are fully immersed in the hollow 78 of the bearing sleeve 70. This is better seen in the view given in FIG. 11*b*, where in addition to the above, the bearing sleeve 70, the worm screw 156, the worm wheel 66, and the radial bearings 64 are also partially removed so to show the hollow 78 of the bearing sleeve 70. As observable from these two figures, the outer tube 10 is situated fully within the housing 60, indicating the column 100 is at minimum height 111. FIG. 11*c* shows a scheme of the driving unit 200 in which the housing 60, inner holder 61, and the inner 20 and outer 10 tubes are fully removed. From FIGS. 11*b* and 11*c* it is observed that, the receiving nut 45 is sitting at the lowest end of the bearing sleeve 70, such that the lead screw 50 is barely visible at its attaching end 46 to the bearing sleeve 70. By this, the height of the telescopic column 100 may be further reduced by the axial length x of the bearing sleeve 70.

FIGS. 12 through 17 depict different states and/or embodiments of an extension unit 300 arranged on the foot element 90 of the height adjustable table 120 according to the second aspect of the invention. The extension unit 300 allows accessing an even wider range of heights of the table 120 by increasing the maximum height of the table 120 even further.

FIG. 12 shows an extension unit 300 with a single extension socket 320 arranged on the foot element 90 of a height adjustable table 120. Note that, the extension unit 300 may be arranged to be fully retracted within the body 92 of the foot element 90 when further maximizing the height of the table 120 is not necessary. This situation is demonstrated in FIG. 12*a*, where a cross sectional view of the foot element 90 is given, exposing a first extension socket 320 fully retracted within the body 92 of the foot element 90. FIG. 12*b* illustrates the same state as FIG. 12*a* with the cross sectional cut going through the extension unit 300 so to expose the elements there within. A core shank 310 is visible, being fixedly attached to the foot element 90 from one end 311. The core shank 310 is hollow, so to enable receiving a tool at the tool accepting end 323 of the first extension socket 320, to provide manual rotation from a tool accepting portion 318. The core shank 310 has screw threads 315 on its outer surface, and is arranged to be within the first extension socket 320 upon full retraction of the extension unit 300. The first extension socket 320 comprises a set of first grooves 325 on the inner side, configured to engage with the screw threads 315 on the core shank 310 upon rotation of the first extension socket 320. As the tool (not shown) is rotated, the first extension socket 320, engages with the threads 315 of the core shank 310 through the first set of grooves 325, and consequently, the first extension socket will move along an axis parallel to the longitudinal axis, extending outwards from underneath the foot element 90.

Figure 13A:
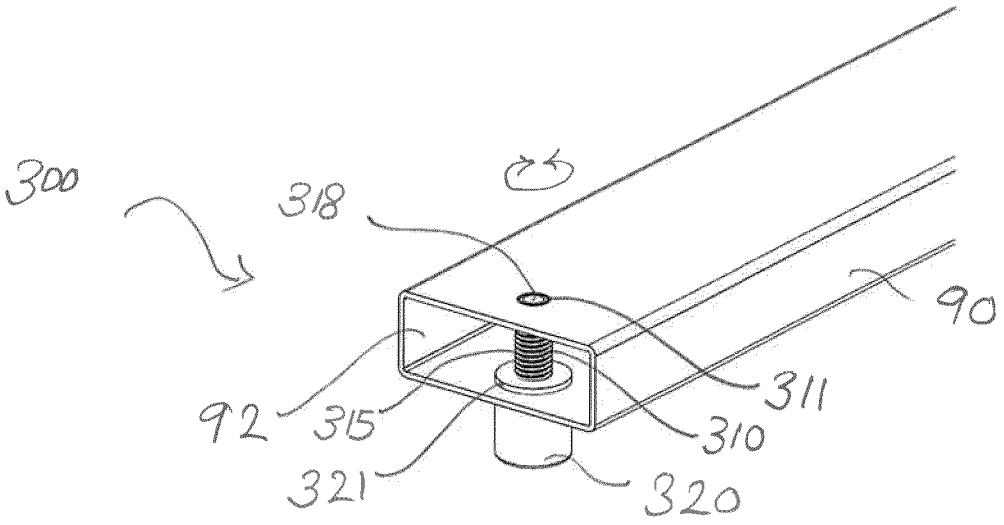
FIG. 13*a-b* an extension unit with a single extension socket at maximum extension.
Figure 13B:
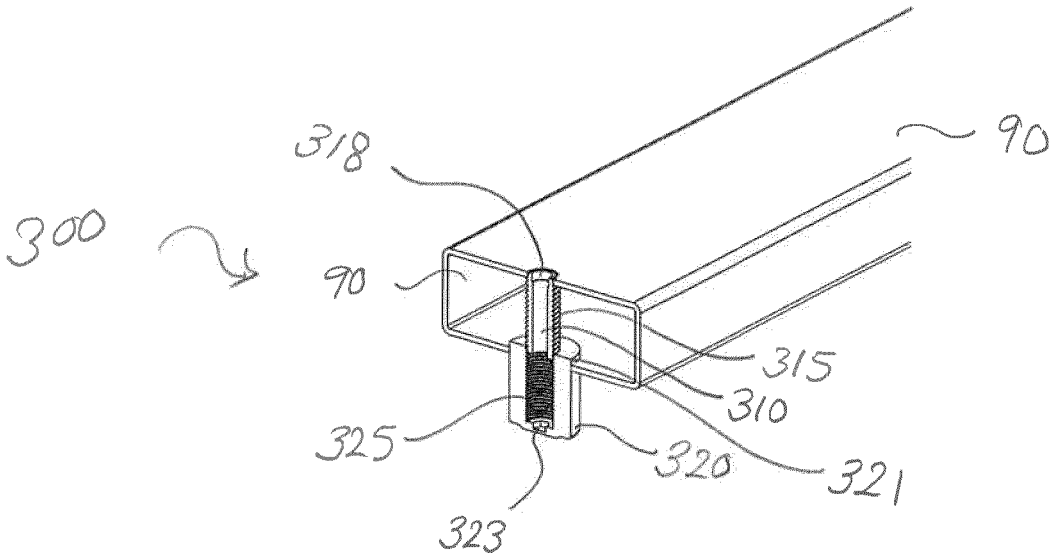

FIG. 13 shows the latter mentioned embodiment of the extension unit 300 at its maximum extension. In FIG. 13*a*, the first extension socket 320 is seen extending underneath the foot element 90. Note that an insignificant portion 321 of the first extension socket 320 remains within the body 92 of the foot element 90 even upon full extension. This is to ensure stability. The screw threads 315 of the core shank 310 are left visibly bare. FIG. 13*b*, illustrates the same state of FIG. 13*a*, wherein the extension unit 300 comprising one extension socket 320 is at its maximum extension, such that the line cute of the cross section goes through the extension unit 300. The interior view of the non-extended portion 321 of the first extension unit reveals that the grooves 325 of the first extension unit 320 are still engaged with the screw threads 315 of the core shank in that portion 321.

Figure 14:
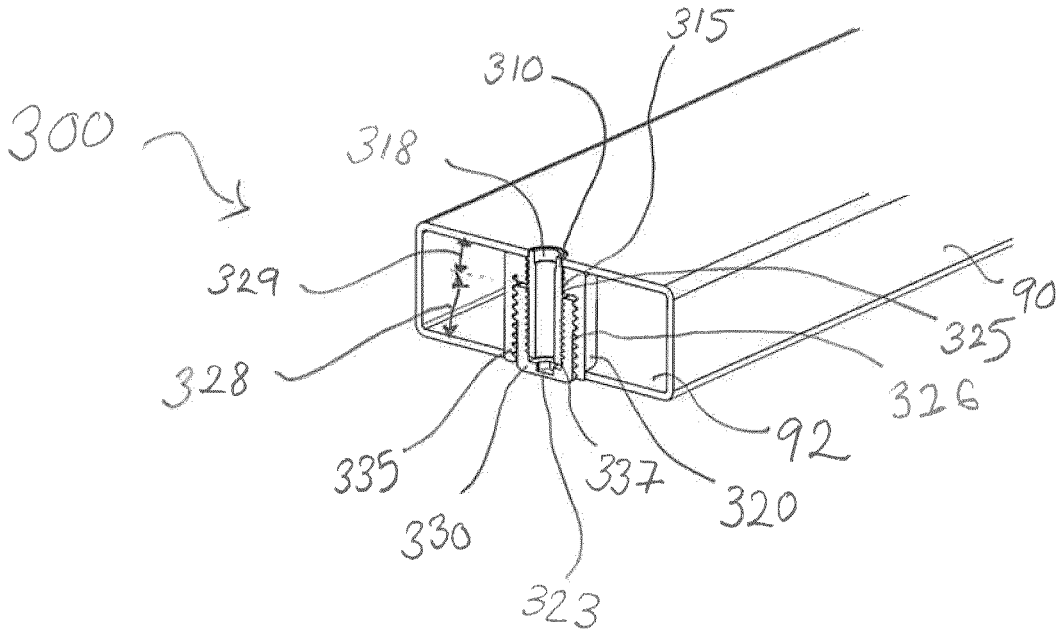
FIG. 14 shows an extension unit with a double extension socket, fully retracted.

FIG. 14 is a schematic illustration of another embodiment of the extension unit 300, namely the double extension socket, at its fully retracted state. This embodiment comprises a second extension socket 330, in addition to the first extension socket 320. The first extension socket 320 is configured to engulf the second extension socket 330 within a portion 328 of itself, when extension unit 300 is in full retraction. From the remaining portion 329, the first extension socket 320 is adjacent the core shank 310, at this state. Again, similar to the previous embodiment, the core shank 310 is hollow, so to enable receiving a tool from the tool accepting portion 318 to be received at the tool accepting end 333 of the second extension socket 330. The first extension socket comprises a set of first grooves on the portion 329 adjacent to the core shank 310, configured to engage it upon rotation of the tool (not shown), and additionally comprises a set of second grooves 326, configured to engage the second extension socket 330. The first 325 and second 326 grooves of the first extension unit may be different in their dimensions. In the particular embodiment demonstrated in FIGS. 14 and 15, they vary in their diameter, and thread pitch. The second extension socket 330 comprises exterior grooves 335 configured to engage the first extension socket 320 through the second grooves 326 of the first extension socket 320.

The first 320 and second 330 extension sockets have different rotational friction with the threads 315 of the core shank 310, and the second grooves 326 of the first extension socket 320 respectively, allowing for sequential activation of the extension sockets 320, 330.

By this, it may be guaranteed that the extension 320, 330 sockets may be extended outwards in sequential order, rather than at the same time.

The extension socket with the lower relative rotational friction will be activated first upon the rotation of the second extension socket 330 by the manual rotation of a tool (not shown) engaged to the tool accepting end 333 of the second extension tool 330, subsequently, when and after that extension socket is extended to its maximum extension, the other extension socket may be rotationally activated through the manual rotation of the tool.

FIGS. 15*a* and 15*b* depict the double extension socket embodiment of the extension unit 300 in its fully extracted state. As can be seen, a portion 321 of the first extension socket 320 remains within the body 92 of the foot element 90, while a portion 331 of the second extension socket 330 remains within the interior of the first extension socket 320. These overlapping portions 321, 331 guarantee stability of the extension unit 300 upon full extension.

It is notable that, it is not necessary that both extension sockets are extended, and that it is not necessary that they are extended to their maximum length, but the amount of extension may be adjusted by the user in order to obtain the desirable table height.

Figure 16A:
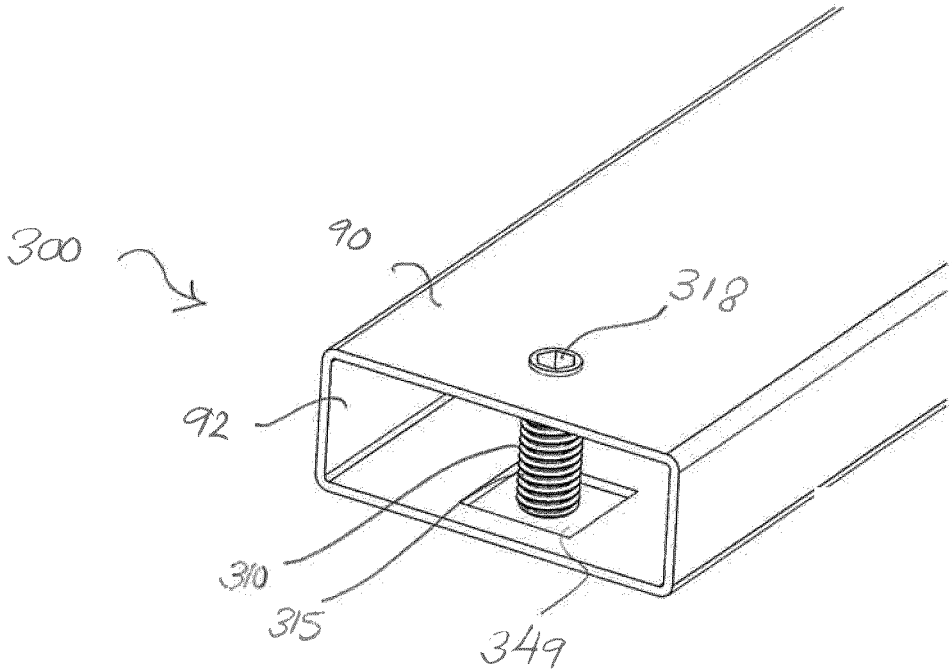
FIG. 16*a-b* an extension unit with a quadratic cross section.
Figure 16B:
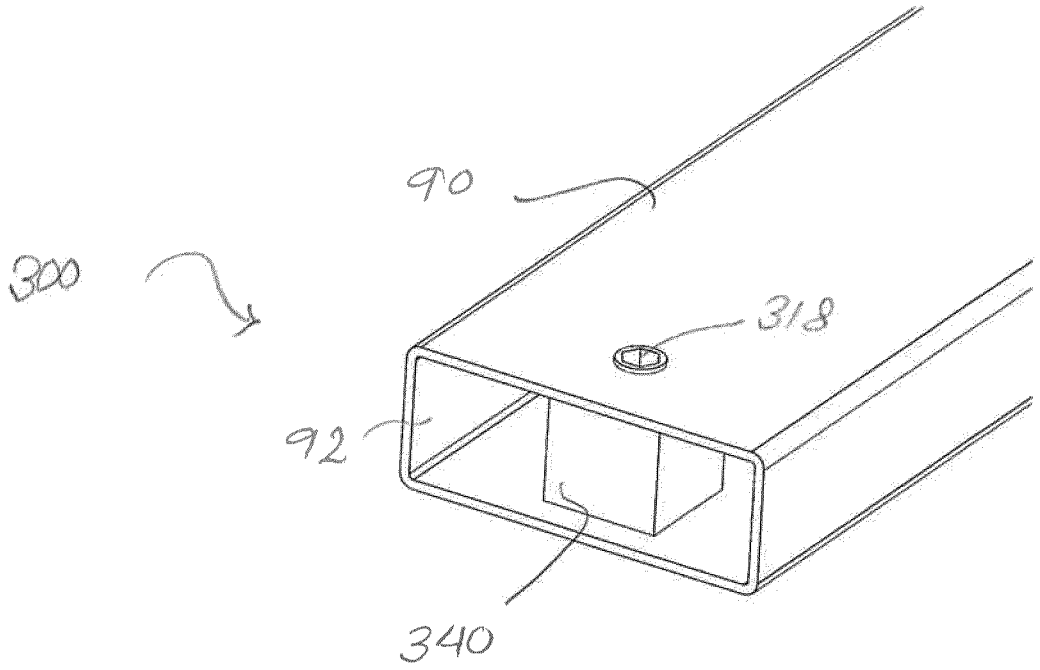

FIGS. 16 and 17 respectively show the retracted and extracted state of an embodiment of the extension unit 300 where the extension socket 340 has a quadratic cross section. In this embodiment comprises only a first extension socket 340. In FIG. 16*a*, the extension socket has been removed so to expose the core shank 210, and the screw threads 315. It the view of FIG. 16*a*, the recess 349 in the foot element 90 through with the extension unit 340 will extend beneath the foot element 90. FIG. 16*b* demonstrates the extension unit 300 with the quadratic single extension socket 340 in the retracted state.

Figure 17A:
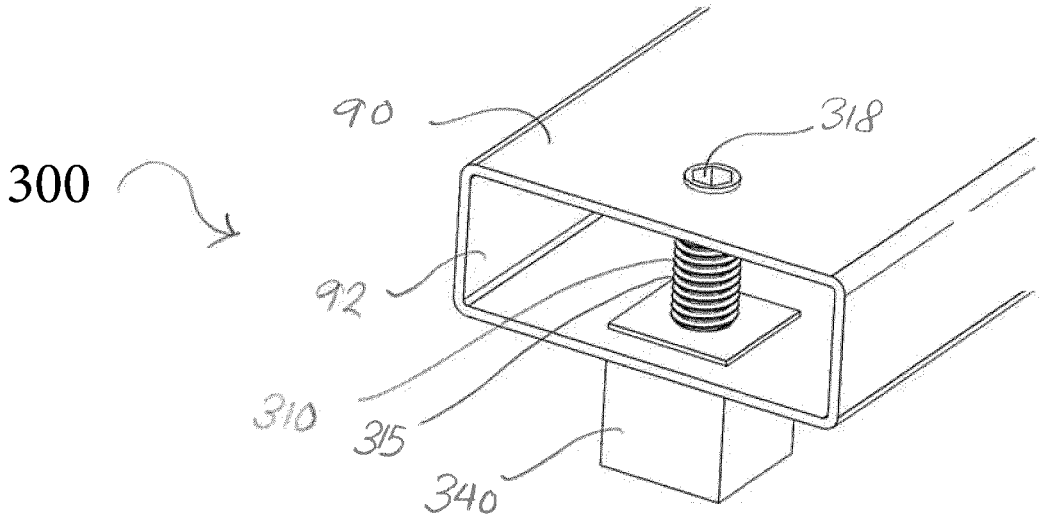
FIG. 17*a-b* an extension unit with a quadratic cross section at maximum extension.
Figure 17B:
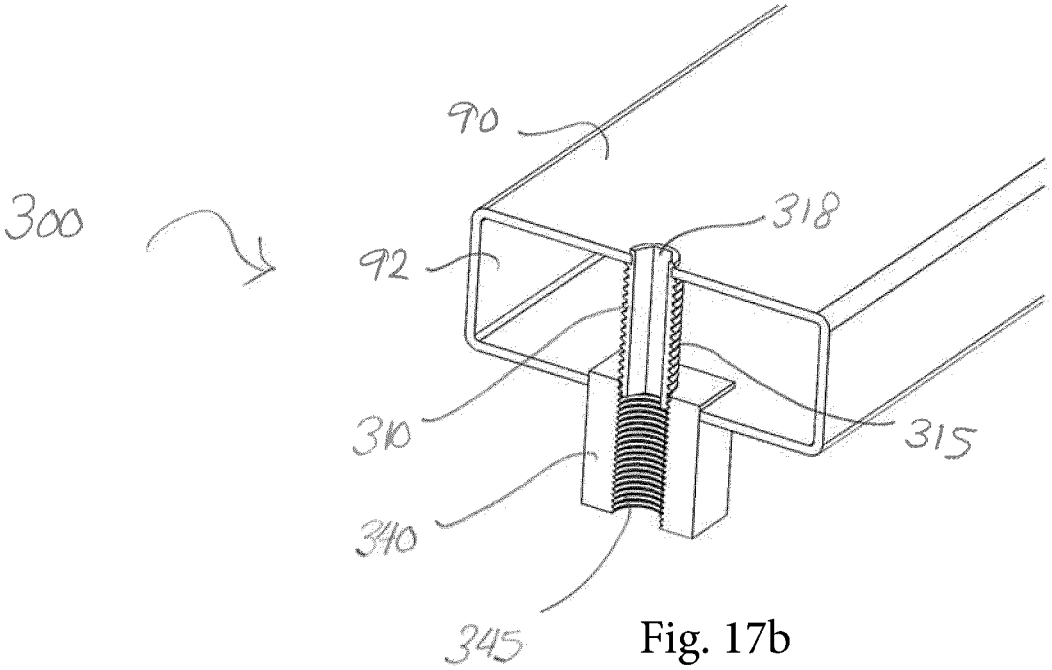

FIG. 17*a* demonstrates the extension unit 300 with a quadratic single extension socket 340 in the fully extracted position, extending beneath the foot element 90. The core shank 310 and its screw threads 315 are visible in the view given in FIG. 17*a*. FIG. 17*b* demonstrates the extension unit 300 with a quadratic single extension socket 340 in the fully extracted state, with a line cut through the elements of the extension unit 300 so to expose the inner elements there within. The inner grooves 345 of the quadratic extension socket 340 are visible. In this embodiment, unlike the previous ones wherein the extension sockets 320, 330 have a circular cross section, enabling their rotation around an axis parallel to the longitudinal axis, the quadratic extension socket 340 cannot rotate. Instead, unlike the previous embodiments, where the core shank 310 is fixedly attached, and is not meant to rotate, in the embodiments for FIGS. 16 and 17 the core shank 310 is made to rotate about the axis parallel to the longitudinal axis. It is noted that, the core shank 310 is only allowed rotational movement, and is otherwise static in the longitudinal and lateral directions. The core shank 310 of this embodiment accepts a tool (not shown) into the hollow of its body through the tool accepting portion 318. When the tool is rotated, the core shank 310 is rotated together with the tool. Through this, the inner grooves 345 of the quadratic extension socket 340 engage with the screw threads 315 of the core shank, enabling the axial movement of the extension socket 340.

It is noted that, the extension socket may have any geometrical cross section, and/or the extension unit may comprise any number of extension sockets.

The person skilled in the art realizes that the present invention by no means is limited to the preferred embodiments described above. On the contrary, many modifications and variations are possible within the scope of the appended claims.

Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

The invention claimed is:

1. A two tube telescopic column for height-adjustable furniture, said two tube telescopic column extending along a longitudinal axis from a first end to a second end of said two tube telescopic column, comprising:

an outer elongated tube fixedly arranged at said second end of said telescopic column, an inner elongated tube having a top end and bottom end, wherein said top end defines said first end of the telescopic column, and wherein the inner elongated tube is sized and adapted to move into and out of said outer tube, drivable by a driving unit along said longitudinal axis between a maximum height and a minimum height, and and an intermediate element having a lower portion being sized and adapted to engage the outer tube from the inside thereof, a middle portion being sized and adapted to be fitted into the inner tube and engage the inner tube from the inside thereof, and an upper portion being sized and adapted to be remain within the inner tube, so as to provide for stability, wherein said intermediate element is passively moved by means of an engaging portion of the inner tube pulling the intermediate member along the longitudinal axis when said telescopic column is moved between said maximum height and said minimum height, wherein the telescopic column further comprises a housing adapted to be fastened to a table top, wherein a top end of the inner elongated tube and a top end of the outer elongated tube are accommodatable within the housing, and wherein said housing is further adapted to allow a worm screw to enter the housing while being driven from a motor positioned substantially external to the housing.

2. A telescopic column according to claim 1, wherein said intermediate element further comprises a corresponding engaging element adapted to interact with the engaging portion of the inner tube, so as to move the intermediate element during an expansion stroke.

3. A telescopic column according to claim 2, wherein said engaging element of the intermediate element defines an onset of said upper portion of the intermediate element.

4. A telescopic column according to claim 2, wherein said intermediate element comprises at least one groove on a portion of an outer surface of said middle portion of said intermediate element, said groove positioned between said engaging element and said lower portion, and arranged to accommodate said engaging portion of said inner tube.

5. A telescopic column according to claim 1, wherein said bottom end of the inner tube is adapted to interact with the lower portion of the intermediate element so as to move the intermediate element during a contraction stroke.

6. A telescopic column according to claim 1, wherein the middle portion of the intermediate element is arranged entirely inside the inner tube when said telescopic column is in a minimum position.

7. A telescopic column according to claim 1, wherein when extended to said maximum height, said inner tube is substantially moved out of said outer tube.

8. A telescopic column according to claim 1, wherein said lower portion of said intermediate element comprises at least one protrusion arranged to protrude from the periphery of said inner tube when said middle portion of said intermediate element is within said inner tube.

9. A table comprising at least one leg comprising a telescopic column according to claim 1, wherein said telescopic column is fixedly attached to the table from said top end of said inner tube, and fixedly attached to a foot element at a bottom end of said outer tube.

10. A table according to claim 9, wherein said bottom end of said outer tube is arranged into a cavity of the foot element, so as to allow the inner tube to enter the foot element when the table is in the minimum height position.

11. A table comprising a telescopic column according to claim 1, further comprising:

a motor, substantially arranged external to said telescopic column, for providing rotary motion to a worm screw extending into the telescopic column, and driving a worm wheel, a hollow bearing sleeve drivably arranged to said worm wheel from the inside thereof, and coupled to a leadscrew so that said leadscrew rotates about said longitudinal axis with said bearing sleeve driven by said motor, and a receiving nut with threads for engaging said leadscrew, said receiving nut being coupled to an output shaft, so as to move linearly along the length of said lead screw upon rotation of said lead screw, wherein said output shaft moves said inner elongated tube into and out from said outer elongated tube upon activation of said motor such that a full extraction of the output shaft along the longitudinal axis will render said maximum height of said telescopic column, and a full retraction will render said minimum height of said telescopic column.

12. A table according to claim 11, wherein said hollow bearing sleeve is arranged to enable further retraction of said output shaft by accommodating an ending portion of said lead screw and said output shaft when further retracted, within the hollow structure of said bearing sleeve.

13. A table according to claim 11, wherein the bearing sleeve and said worm wheel are situated inside a housing positioned at the first end of the telescopic column, said housing arranged to accommodate a portion of said lead screw, and said output shaft when output shaft is retracted.

14. A table according to claim 11, wherein said housing further comprises at least one axial bearing so to decrease rotational friction of the bearing sleeve with rotation of the worm wheel.

15. A table according to claim 11, wherein said housing further comprises at least one radial bearing so to radially secure said bearing sleeve, and decrease friction upon rotation of said bearing sleeve relative to said worm wheel.

16. A table according to claim 11, wherein said foot comprises an extension unit situated within an inner volume of said foot, and manually extendable under said foot parallel to said longitudinal axis, said extension unit comprising:

a core shank positioned within said inner volume of the foot, and fixed from one end to said foot, said core shank comprising screw threads on an outer surface, and a first extension socket, said extension socket comprising first grooves on a first portion of an inner surface, said first grooves arranged to engage with said screw threads of the core shank and rotate about an axis parallel to said longitudinal axis, rendering rotatable extension and retraction of said extension socket out from and into said hollow volume of the foot, respectively, said core shank being hollow, and adapted to receive a tool for exerting a rotation of the core shank relative the first extension socket so as to adjust the total length extension of the extension unit.

17. A table according to claim 16, wherein said first extension socket of said extension unit further comprises second grooves on a second portion of said inner surface.

18. A table according to claim 16, wherein said extension unit of said foot further comprises:

a second extension socket, comprising grooves on a portion of an outer surface arranged to engage with said second grooves of said first extension socket and rotate about said longitudinal axis, rendering rotatable extension and retraction of said extension socket out from and into said first extension socket, respectively.

19. A table according to claim 16, wherein said second of grooves of the first extension socket comprises at least one different characteristic from said first grooves of the first extension socket.

20. A table according to claim 16, wherein the first and second extension sockets have different rotational friction with said threads of the core shank, and said second grooves of the first extension socket, respectively, allowing for sequential activation of the extension sockets.

* * * * *